United States Patent [19]

Zitelli et al.

[11] 4,133,615

[45] Jan. 9, 1979

[54] MICROPROCESSOR-BASED, PROGRAMMED TURBINE SPEED CONTROL SYSTEM

[75] Inventors: William E. Zitelli, Monroeville Borough; James M. Mussler, Bethel Park, both of Pa.

[73] Assignee: Westinghouse Electric Corporation, Pittsburgh, Pa.

[21] Appl. No.: 787,636

[22] Filed: Apr. 14, 1977

[51] Int. Cl.[2] ..... F01D 17/06

[52] U.S. Cl. ..... 415/43; 415/36

[58] Field of Search ..... 415/1, 30, 36, 40, 42, 415/43

[56] References Cited

U.S. PATENT DOCUMENTS

| | | | |
|---|---|---|---|
| 3,741,246 | 6/1973 | Braytenbah | 415/17 |
| 3,798,909 | 3/1974 | Barnett | 415/30 |
| 3,834,830 | 9/1974 | Johncock | 415/40 |
| 3,859,007 | 1/1975 | Kowalski | 415/30 |
| 3,891,344 | 6/1975 | Braytenbah | 415/1 |
| 4,016,723 | 4/1977 | Farley | 415/30 X |

*Primary Examiner*—Louis J. Casaregola
*Attorney, Agent, or Firm*—W. E. Zitelli

[57] ABSTRACT

A microprocessor-based control system for controlling the speed of a steam turbine by governing the steam supplied thereto from a steam supply source using one or more hydraulically operated servomotor throttle valves is disclosed. The operation of the speed controller is characterized by a plurality of permanently preprogrammed read-only memories containing sets of instructions and data words arranged in an addressable order. The instructions and data words are synchronously processed by the microprocessor as governed by a system clock. Apparatus is provided to initialize the status of the speed controller under the control of the microprocessor in accordance with the processing of one portion of the sets of programmed instructions and data words thereby. The remaining portion of the program is processed by the microprocessor as governed by a real time clock for coordinating the operation of an operator's panel interfaced to the controller and for monitoring the turbine speed and controlling the position of the one or more valve servomotors in accordance therewith. The subportion of the remaining portion of the program primarily characterizing the panel coordination functions is processed during each even period of the real time clock. Accordingly, the subportion of the remaining portion of the program primarily characterizing the turbine speed control is processed during the odd periods of the real time clock.

7 Claims, 13 Drawing Figures

16
DP1
DP2
140 MSD
141
142
143 LSD
144 MSD
145
146
147 LSD
ABCDEFGHJK
R1
L1
R2
L2
R3
L3
Vc+
V+
PB0
PB1
PB2
PB3
PB4
PB5
PB6
Vcc+
SYSTEM SOURCE
102
106
138
150
152
154
156
158
160
162
164
166
168
170
172
110
112
114
116
118
120
122
124
126
128
130
132
134
136

43
43A
43B
100
104
110
112
190
Vcc+
37
58
27
P1A0
54
SPEED MONITORING INTERFACE
31
32
33
61
65
19
18(CBI)
39
40
CA1
CA2
CB2
217
V+
RTCINT
14

MICROPROCESSOR-BASED, PROGRAMMED TURBINE SPEED CONTROL SYSTEM

BACKGROUND OF THE INVENTION

1. Field of the Invention

This invention relates to a speed control system for controlling the speed of a turbine by modulating the position of a servomotor throttle valve disposed between the turbine and a stream source for controlling the admission of steam to the turbine, and more particularly, to a microprocessor-based control system incorporating a plurality of permanently pre-programmed read-only-memories which characterize the operation of the speed control system.

2. Prior Art Discussion

Recently, general purpose minicomputer systems have been developed for the purposes of controlling the speed and load of a steam turbine. Minicomputer-based turbine controllers, similar to that described in the U.S. application, Ser. No. 722,799 (abandoned), entitled "Improved System And Method For Operating A Steam Turbine And Electric Power Generating Plant"; filed by Giras and Birnbaum on Apr. 4, 1968 and continued as Ser. No. 124,993 on Mar. 16, 1971 and Ser. No. 319,115 (abandoned) on Dec. 29, 1972 and Ser. No. 720,725 on Sept. 7, 1976, permitted turbine control operation to be characterized by a set of programs. Quite a few large turbine systems could justify the expense of a general purpose, minicomputer-based turbine controller because of the added features of automatic start-up, synchronization and automatic efficient load control afforded thereby. However, some municipalities and industrial complexes employ smaller turbines, on the order of 300 megawatts of less, which incorporate simple steam admission control valving arrangements usually actuated by mechanical-hydraulic servomotors as opposed to the large turbines, say 1,000 megawatts or greater, which use a variety of complex electrohydraulic actuated valving arrangements. These smaller turbines have generally been controlled by an operator using a basic fixed hardwired digital speed controller such as that described in U.S. Pat. No. 3,802,188; by Barrett, issued Apr. 9, 1974. In these cases, the operator performs the protective control of the turbine, manually, according to a set of operational limitations provided to him by the turbine manufacturer.

Presently, there exists some controversy surrounding the effectiveness of using a general purpose minicomputer-based machine for controlling small turbines, particularly where only a single loop speed control function is required. Normally, each general purpose minicomputer incorporates a number of system software type programs for coordinating the operation of the circuitry associated therewith. In order to apply a minicomputer to a specific function, one must, for the most part, be fully knowledgeable of the "operating systems" software package corresponding thereto. These "operating systems" dictate the priority structuring and arrangement of the sets of instructions and data programmed therein for the purposes relating to steam turbine speed control applications, for example.

Programs associated with both application and circuit operation are generally stored on rolls of punched paper tape prior to being entered into the minicomputer system. The order in which programs are entered into the read/write memory of the minicomputer system is performed in accordance with the specific system program generation procedures outlined by the "operating system" corresponding to the minicomputer used. Accordingly, additional peripheral equipment, non-essential to the control of the process, such as a tape punch, a tape reader and a teletypewriter are generally needed to ensure that proper program loading techniques have been instituted and that the programs have been assigned to the correct memory areas as a result of the loading process. It has become necessary then to not only be knowledgeable about the process that is to be controlled, but to also become equally knowledgeable about the complexities involved in loading the programs into the minicomputer systems being used in accordance with the procedures of its "operating system".

Present minicomputer systems also involve read/write memory which is susceptible to electrical noise "spikes" which occur frequently in power plant environments. Frequent occurrences of these "spikes" may cause a change in an instruction in the read/write memory which could be responsible for an eventual shutdown of the turbine process.

SUMMARY OF THE INVENTION

In accordance with the present invention, a system architecture more specifically related to the process being controlled, the speed of a steam turbine, is provided to improve the effectiveness of computerized control thereof. The cost advantages of time sharing a central processor using sets of instructions and data words programmed in memory for the operational characterization of the speed controller functions is maintained. Further the invention provides for permanent storage of the characterizing instructions and data words in easily installable modular pre-programmed memory devices to eliminate the need for peripheral loading and validity checking equipment and the program loading techniques associated therewith. In addition, the permanent memory storage will enhance the protection against electrically induced noise "spikes" and will effect the emulation of a hardwired system power-on operation. Also, a system not limited to an "operating system" software package is provided to permit a more basic program organization at the bit control level for the purposes of controlling the speed of a steam turbine.

More specifically, a microprocessor-based control system controls the speed of a steam turbine by governing the steam supplied thereto using one or more hydraulically operated servomotor throttle valves. Characterizing sets of instruction and data words, permanently pre-programmed in read-only-memories, are processed by a microprocessor as governed by a system clock. Apparatus is provided to initialize the status of the speed controller under the control of the microprocessor in accordance with the processing of one portion of the sets of programmed instructions and data words thereby. The remaining portion of the program is processed by the microprocessor as governed by a real time clock for coordinating the operation of an operator's panel interfaced to the controller and for monitoring the turbine speed and controlling the position of the one or more valve servomotors in accordance therewith. The sub-portion of the remaining portion of the program primarily characterizing the panel coordination function is processed during each even period of the real time clock. Accordingly, the subportion of the remaining portion of the program primarily characterizing the turbine speed control is processed during the odd periods of the real time clock.

DESCRIPTION OF THE PREFERRED EMBODIMENT

1. Overall System Architecture

Figure 1:
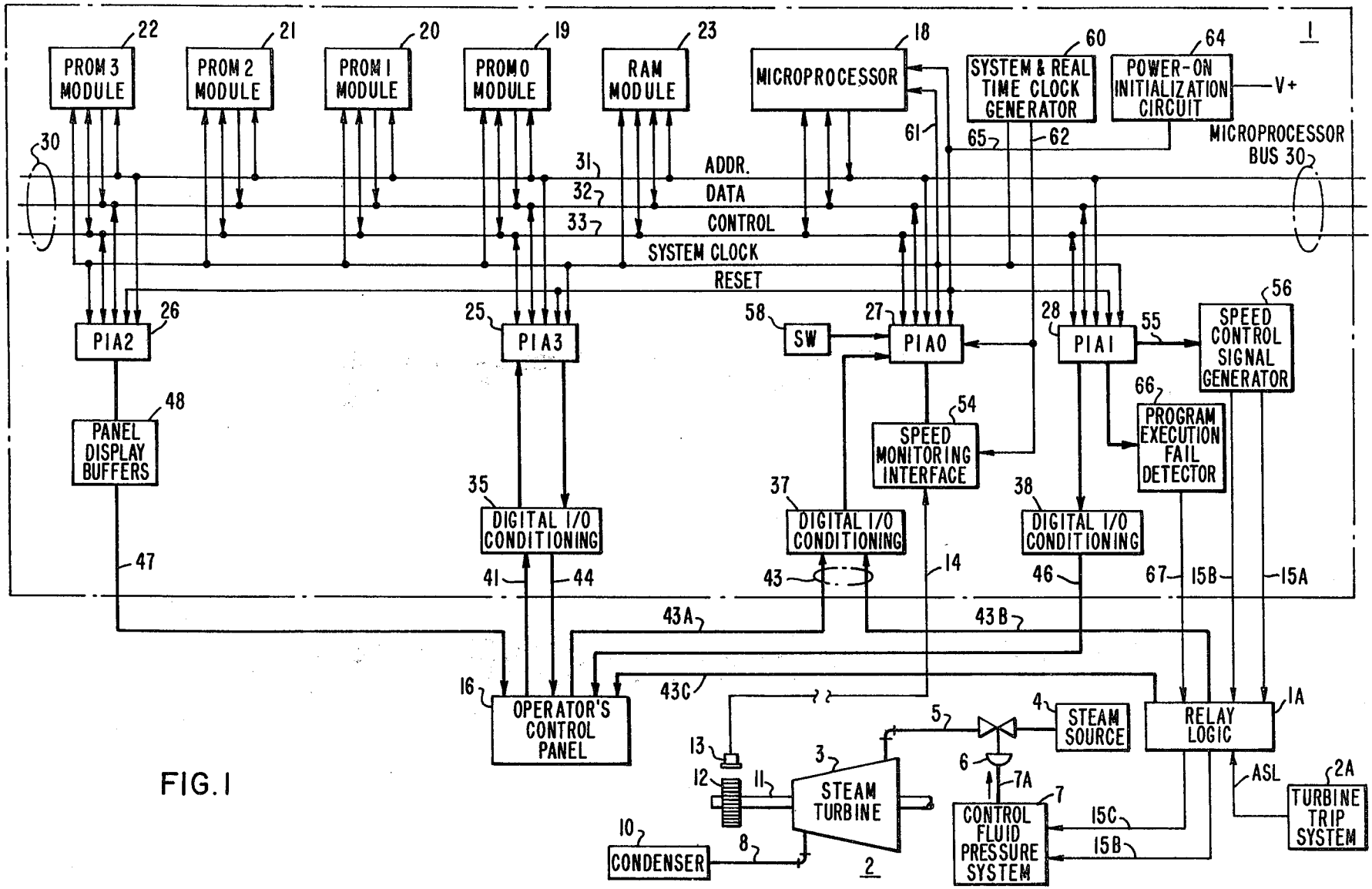
FIG. 1 is a schematic block diagram of a turbine speed control system and a steam turbine system embodying the present invention.

Referring to FIG. 1, a microprocessor-based turbine speed controller 1 may be used to control the speed of a steam turbine system 2 in accordance with an operational characterization programmed therein. Steam is supplied to a steam turbine 3 from a conventional steam source 4 through steam piping 5. One or more steam admission valves 6 which may be of the throttle valve servomotor type are actuated by a control fluid pressure system 7 to govern the steam flow to the steam turbine 3. Steam exhausts from the steam turbine 3 through exhaust piping 8 to a condenser 10. As steam expands through the steam turbine 3, energy is transferred to the turbine blading, not shown in FIG. 1, to exert a torque on a turbine shaft 11. The net torque of the steam turbine 3 imparted to the shaft 11 accelerates the shaft to a desired speed. Speed may be detected by utilizing a notched wheel 12 attached to turbine shaft 11 and a standard variable reluctance type detector 13 coupled adjacent thereto, for example. Detector 13 normally generates a periodic time varying signal of a waveform similar in nature to a sine wave over signal line 14. The frequency of the generated time varying waveform is generally proportional to the speed of the turbine shaft 11. The speed signal generated over line 14 is monitored by speed controller 1 and a speed control signal 15A and return signal path 15B are provided thereby in accordance with the programmed operational characteristics thereof. An operator's panel 16 is used to coordinate the speed control activities of the speed controller 1 in both an automatic or supervisory mode.

More specifically, a microprocessor 18 processes instructions contained in a plurality of memory devices 19, 20, 21, 22 to read in data, to perform logical or arithmetic operations on data contained therein, and to write out processed data. A selected portion of the processed data may be stored in a temporary storage device 23. The microprocessor 18 additionally controls the flow of input/output (I/O) data using a plurality of programmed interface units 25, 26, 27 and 28. All of the aforementioned devices 18 through 28 may be connected in parallel to a common microprocessor bus 30 which includes signal conduction portions for an address word 31, bidirectional data words 32 and control signals 33. Digital input and output signals are conditioned prior to being monitored and controlled by signal conditioning functions 35, 37 and 38 which are coupled to interface units 25, 27 and 28, respectively. Digital inputs 41 and 43 are provided in this embodiment from push buttons on control panel 16 and from contacts in relay logic 1A identifying the status thereof. Digital output signal 44 and 46 are supplied for the purpose of this embodiment to drive status lamps on the control panel. Additional digital output signals 47 are suitable for driving digital binary coded decimal (BCD) displays, which are located on the operator's panel 16, through panel display buffer 48 which is coupled to interface unit 26.

The periodic time varying speed signal of signal line 14 is an input to the speed monitoring interface 54 which, in turn, is coupled to the interface unit 27. Accordingly, a digital speed control signal 55 is generated from the interface unit 28 and converted to the analog speed control signal 15A by a speed control signal generator 56. The speed control signal 15A is transformed by relay logic 1A into signal 15C which eventually controls a torque motor (see FIG. 3) in the control fluid pressure system 7 to govern the positions of the one or more inlet steam admission valve servomotors 6 which vary the steam conducted to the steam turbine 3 thereby controlling the speed of the turbine 3. An arrangement of switches 58 are also coupled to the interface unit 27. The switches 58 may be positioned in a plurality of states as will be described in further detail herebelow.

Such that the transfer of the address word 31, the data word 32 and control signals 33 are conducted over the microprocessor bus 30 synchronous to the sequential processing operations of the microprocessor 18, a system clock generator 60 is provided. A system clock signal 61 generated thereby is distributed to all of the devices coupled to the microprocessor bus 30. A real time clock signal 62 is also generated by the generator 60 and supplied to the speed monitoring interface 54 and the interface unit 27. Initialization of the turbine speed controller 1 is initiated by the power-on initialization circuit 64 by supplying an initialization signal 65 to the microprocessor 18 and interface units 25, 26, 27 and 28. To identify a malfunction in program execution of the microprocessor 18, a failure detect circuit 66 is coupled to interface unit 28 to provide a failure detect signal 67 which energizes a relay in relay logic 1A.

To provide turbine protection, relay logic 1A is provided to condition the speed control signal 15A in accordance with an auto stop latch (ASL) signal provided by a conventional turbine trip system 2A. The ASL signal is true only at times when the hydraulic fluid used to control the positions of the steam admission valves 6 is at a sufficient pressure to adequately perform the hydraulically controlled positioning of the servomotors 6.

For the purposes of this embodiment, a family of large scale integrated (LSI) circuit devices similar to that manufactured by Motorola Semiconductor Products, Inc., namely the M6800 Microcomputer Family, are used. The microprocessor 18 may be of the type MC6800 Microprocessing Unit (MPU); the temporary storage memory device 23 may be of the type MCM6810 Static Random Access Memory (128 × 8); the interface units 25 through 28 may be of the type MC6820 Peripheral Interface Adapter (PIA) — all manufactured by Motorola. The memory devices 19, 20, 21 and 22 may be of the type manufactured by Intel Corp. Model No. 3604 programmable read-only-memory (PROM) wherein each device may store 512 8-bit words. The selected addressable order in which predetermined instructions and data words are permanently programmed in the memory devices as will be described in greater detail herebelow shall characterize the sequential operation of the speed controller 1. The speed controller 1 is similar to the one described in U.S. Patent application Ser. No. 771,141, entitled "A Programmable Turbine Speed Controller" filed on Feb. 23, 1977 by Zitelli, Mussler and Szabo which is incorporated by reference herein to provide a description of the apparatus and operation thereof in greater detail.

Typically, the operation of the speed controller 1 starts from the power V+ being turned on. The power-on initialization circuit 64 detects the power turn-on condition and responds by sending an initialization pulse of a pre-selected time duration over line 65 to the microprocessor 18 and interface units 25 through 28. A plurality of programming registers contained in the interface units, not shown in FIG. 1, are cleared to all logical zeros during the initialization pulse. The microprocessor 18 responds to the reset pulse by vectoring to its starting instruction address as programmed in one of the memory devices 19 through 22. After the initialization pulse, the microprocessor 18 proceeds to process the programmed instructions of the memory devices 19 through 22 at a frequency controlled by the system clock signal 61. At times, designated by the addressable order of the instructions of the memory, the microprocessor 18 may address one or more of the registers contained in the interface units 25 through 28 to read data from or write data into said registers as controlled by the system clock signal 61, state of the control signals 33 and address of the corresponding register. This will be explained in more detail herebelow.

Normally the speed signal 14 as conditioned by the speed monitoring interface 54 is read in by the microprocessor 18 at a minimum frequency which will allow stable control of the steam turbine 2. The speed signal monitoring frequency is usually determined by the real time clock signal 62. Likewise, the speed control signal generator 56 may be updated at a similar frequency to ensure stable control of the steam turbine 2 by the speed control signal 15A. The operation of the turbine controller 1 is characterized by the set of programmed memory devices 19 through 22 to read in a speed signal data word through interface unit 27, to operate on this speed signal and to generate a new speed control signal 55 which is written out to interface unit 56. Digital outputs included in signals 44, 46 and 47 which are coupled to status lamps, and displays on operator's control panel 16 are updated at a frequency synchronous to the clock signal 62. Normally, the digital inputs included in signals 41 and 43 change state asynchronous to the clock signal 62, however these digital input states are monitored at times synchronous to the real time clock frequency signal 62. That data which is constantly being updated by the processing operation of the microprocessor 18 may be temporarily stored in predetermined addressed registers of the temporary storage memory 23.

Figure 2:
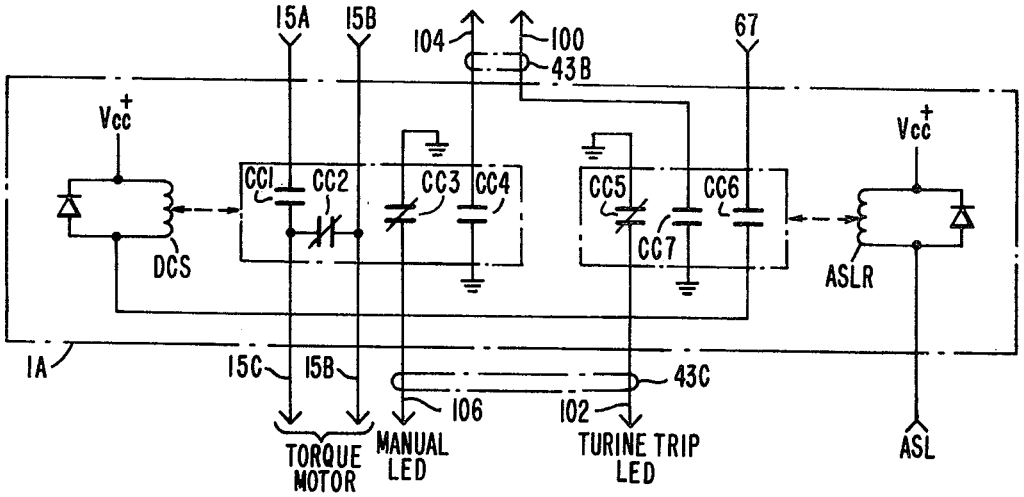
FIG. 2 is a detailed schematic of relay logic suitable for use in the control system of FIG. 1.

Referring to FIG. 2, the ASL signal from the conventional turbine trip system 2A energizes a relay ASLR when in the true state. The relay is supplied with power by voltage source, Vcc+. When energized, relay ASLR closes normally open, NO, contacts CC6 and CC7 and opens normally closed, NC contact CC5. In addition, when NO contact CC6 is closed, a signal path is provided between the failure detect signal 67 and another relay DCS. If speed controller 1 is functioning properly, signal 67 is permitted to energize relay DCS only if relay ASLR is energized. When relay DCS is de-energized, NO contact CC1 "open circuits" signal 15A from 15C and NC contact CC2 "short circuits" signal 15C to 15B which is at essentially ground potential for the purposes of this embodiment. When relay DCS is energized, NO contacts CC1 and CC4 are closed and NC contact CC2 and CC3 are opened.

In operation then, as the hydraulic pressure for operating the valve servomotors 6 increases to an adequate level, signal ASL becomes true energizing relay ASLR. Signal 100 which is a portion of 43B is conducted to ground potential and signal 102 which is a portion of 43C is disconnected from ground potential and a signal path is provided between signal 67 and relay DCS. If speed controller 1 is functioning, signal 67 will energize relay DCS. Signal 15C will be disconnected from ground potential and conducted to signal 15A. Signal 104 which is a portion of 43B is conducted to ground potential and signal 106 which is a portion of 43C is disconnected from ground potential. Should a "turbine trip" be initiated during a speed control operation, both relays ASLR and DCS will become de-energized as a result of ASL becoming false. All relay contacts will respond to their normal de-energized state.

Figure 3:
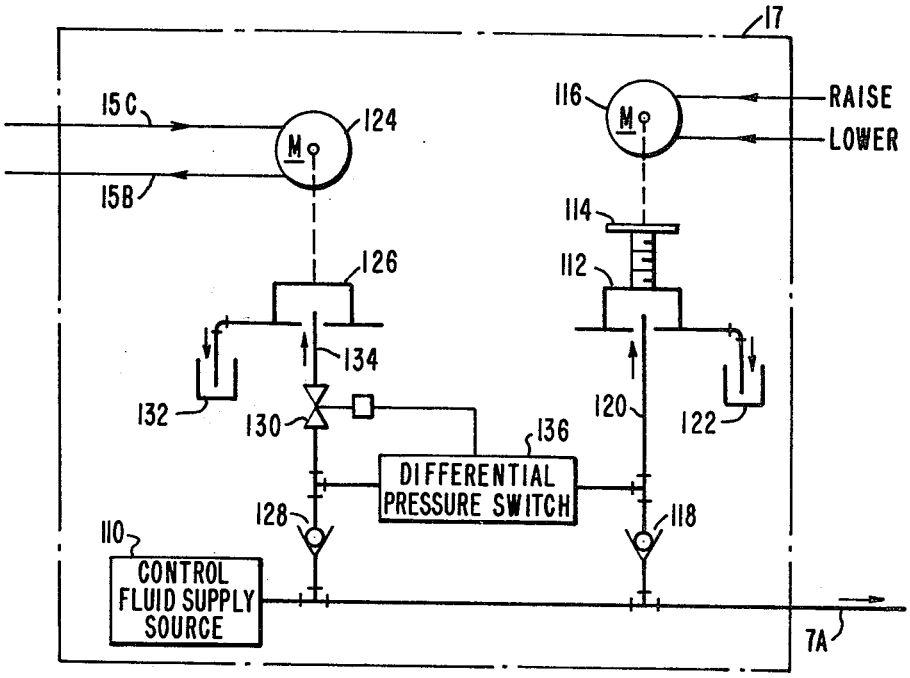
FIG. 3 is a schematic diagram illustrating a typical control fluid pressure system.

In FIG. 3, the pressure in the control fluid signal line 7A is controlled either automatically or manually from a control fluid supply source 110. Under automatic operation, a conventional cup valve arrangement 112 is tightly closed by either a handwheel 114 or an electric motor 116 which are both geared in a conventional manner to position the cup valve 112. With cup valve tightly closed, no control fluid is permitted to flow through check valve 118 and piping 120 to drain 122 thereby eliminating the effects of this manual portion of the control fluid pressure system 7. In accordance with automatic control, a torque motor 124 is controlled by speed control signal 15C and return line 15B to position another conventional cup valve arrangement 126 coupled thereto. The position of the cup valve 126 controls the flow of control fluid from control line 7A through a check valve 128 and a typically motor operated valve 130 to drain 132 using line 134. The amount of flow of control fluid from line 7A fixes the pressure therein and it is this pressure which positions the steam admission servomotor valve 6 as shown in FIG. 1.

In the present embodiment, should a malfunction in the speed controller 1 occur or a loss in hydraulic fluid pressure occur, the associated DCS relay or both relays, as the case, may become de-energized causing the signals 15C and 15B coupled to the torque motor 124 to be "shorted" together. With no signal supplied thereto, the torque motor 124 opens the cup valve 126 to a wide open position such to bring the pressure in line 7A to a substantially low state. This low pressure in line 7A will bring the servomotor valve 6 to a closed position. A suitable method of transferring to manual control of the pressure in the control line 7A is to first crank open cup valve 112 with either the handwheel 114 or electric motor 116. When the pressures in the lines 120 and 134 are brought to within +1 PSI of each other as detected by a differential pressure switch 136, the motor actuated valve 130 is permitted to close. Control of the position of the cup valve 112 will maintain the control fluid pressure in line 7A once the automatic portion of the control fluid pressure system 7 is no longer effective.

Figure 4:
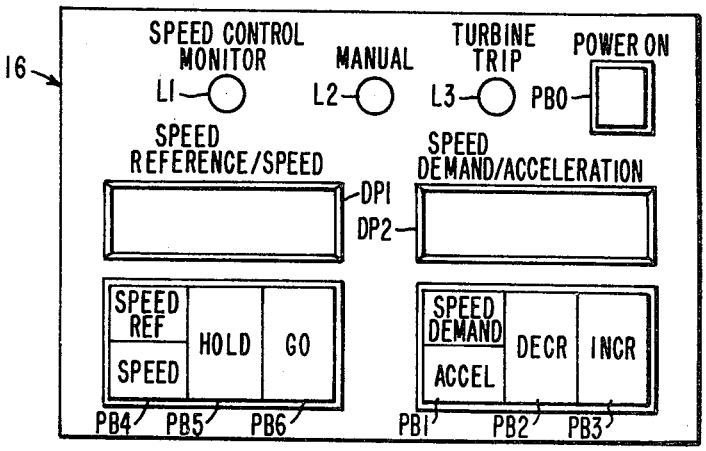
FIG. 4 is a diagram of a panel layout suitable for use in the control system of FIG. 1.

An operator's control panel 16 used for the purposes of controlling the speed of a turbine system through the utilization of the speed controller 1 is shown in FIG. 4. A display window DP1 which may be comprised of four numerical digits can be affected to display either a speed reference signal or an actual speed signal using a pushbutton PB4. The split lens backlighting of PB4 provides an indication to the operator as to which parameter is displayed in the display window DP1. A display window DP2 which may also be comprised of four numerical digits can be affected to display either a desired acceleration of the speed reference signal or a desired speed demand (target) of the speed reference using a pushbutton PB1. The split lens backlighting of pushbutton PB1 provides an indication to the operator as to which parameter is displayed in the display window DP2.

Decrease and increase pushbuttons, PB2 and PB3, respectively, when depressed, perform mutually exclusive operations to set the parameter in window display DP2 to a desired setting. For example, if the speed controller 1 is controlling turbine speed around a speed reference setting of 1800 RPM and it is desired to increase that speed to 2100 RPM per minute, the acceleration parameter is entered in the window DP2 and the increase or decrease pushbuttons, PB3 or PB4, is depressed to bring the acceleration to 200 RPM. A suitable algorithm is used to step the displayed parameter to that desired as a function of the number of integer seconds that the pushbutton, PB2 or PB3, is depressed. That algorithm may be expressed by the following equation:

$$N_n = \frac{n(n+1)}{2} \qquad (1)$$

where $N_n \equiv$ the integer variation in the window parameter for n seconds, and $n \equiv$ total time in seconds that pushbutton was depressed.

Suppose that in our example, the acceleration is presently set at 319 RPM per minute. To bring the acceleration to 200 RPM per minute, the decrease PB2 is depressed for 15 seconds for a total decrease of 120 in accordance with equation (1) above which results in a reading of 199. Then, the increase PB3 is depressed for 1 second resulting in the desired acceleration setting of 200 RPM per minute in window DP2. Similarly, the speed demand may be set by just entering the speed demand parameter in DP2 using PB1 and then, exclusively depressing either pushbutton PB2 or PB3 to set the desired value.

To initiate the ramping of the speed reference to its demand (target) value at the desired acceleration, a GO pushbutton PB6 must be depressed. The pushbutton is backlighted to provide an indication to the operation of the operation which is being performed. The speed reference ramping may be inhibited at any time by depressing a HOLD pushbutton PB5 which is also backlighted during a HOLD mode. To re-initiate the ramping operation, pushbutton PB6 is again depressed. When the speed reference becomes equal to the speed demand setting the ramping operation is terminated.

Figure 5:
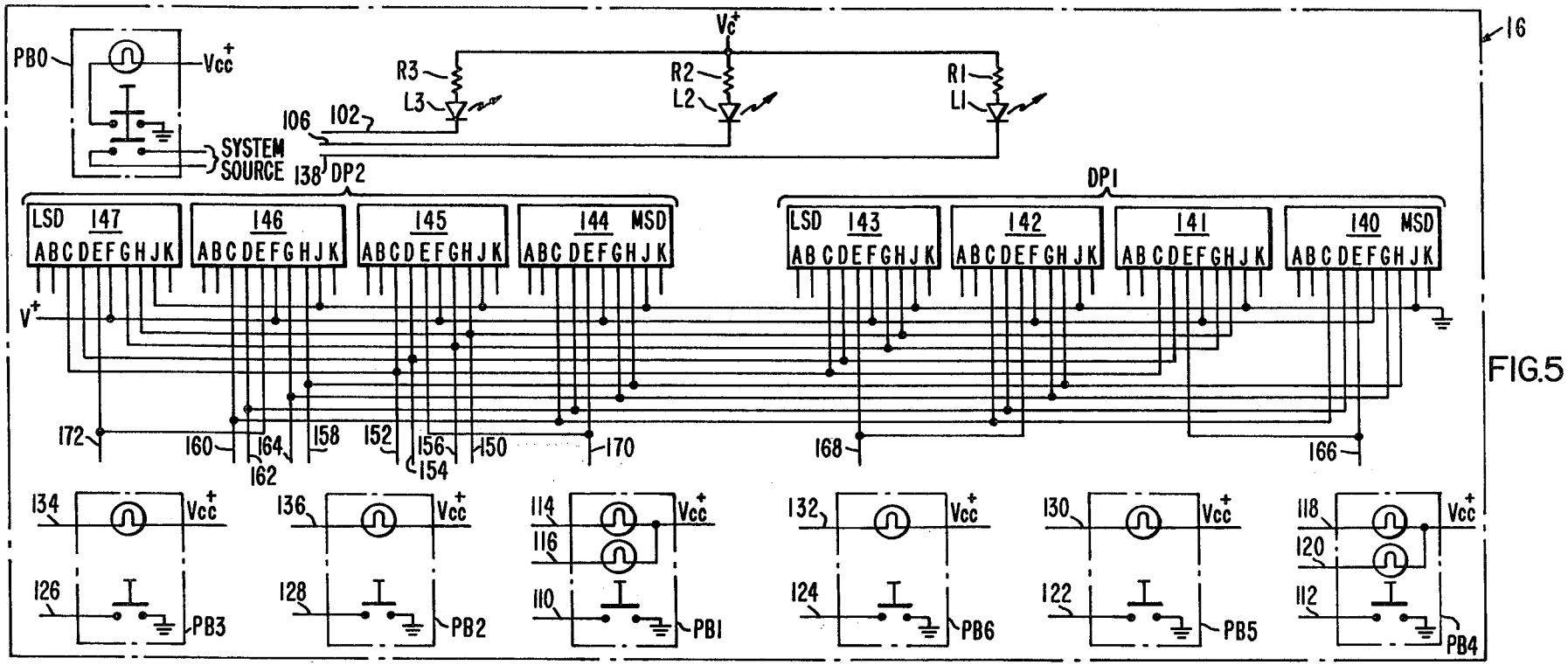
FIG. 5 is a schematic wiring diagram of the panel depicted in FIG. 4.

Light emitting diode (LED) monitor lamps L1, L2 and L3 are provided on panel 16 to indicate status. The Turbine Trip lamp L3 is lit in response to the de-energized state of the ASLR relay of FIG. 2 using signal line 102 as shown in FIG. 5. The Manual lamp L2 is lit in response to the de-energized state of the DCS relay of FIG. 2 using signal line 106 as shown in FIG. 5. The Speed Control Monitor lamp L1 is lit by the speed controller during times when the error between the speed reference and actual speed is beyond a predetermined value. A power-on pushbutton PBO is supplied with the panel 16 to provide power from a source to the speed controller system. The pushbutton PBO is mechanically fashioned to backlight when power is turned on.

The cooperation between depressing pushbuttons, backlighting pushbuttons, displaying parameters and status as previously described above in connection with panel 16 is all performed in accordance with instructions as preprogrammed in a fixed addressable order in the PROM devices 19 through 22 of the speed controller 1. These operations will be better understood after reading the program organization and operation section which is described in detail herebelow. A possible apparatus structure to permit control of the operator's panel 16 by the speed controller is as shown in FIG. 5. FIGS. 6, 7, 8 and 9 will be referred to from time to time in connection with the description of the schematic depicted by FIG. 5.

Figure 6:
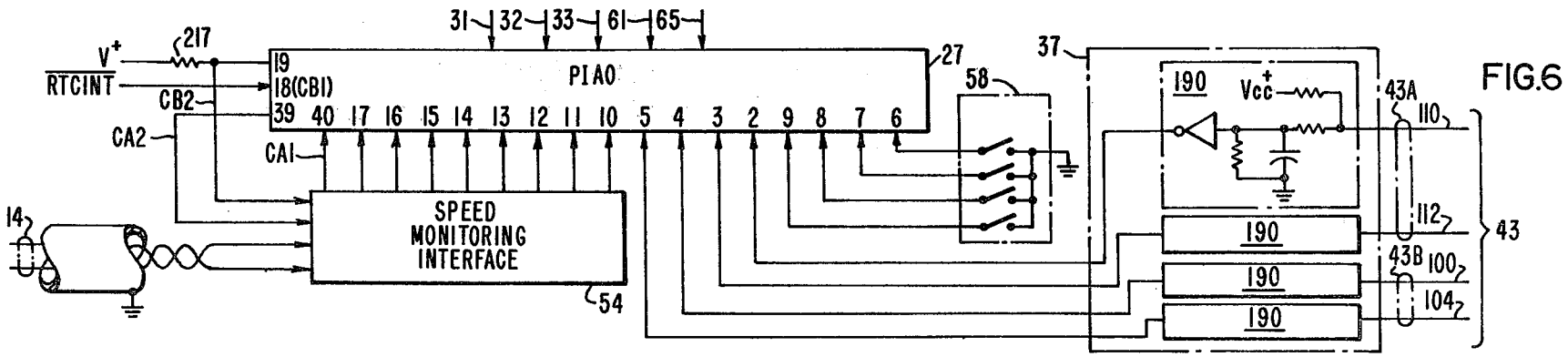
FIG. 6 is a schematic block diagram of a speed monitoring and digital input interface unit for use in the system of FIG. 1.
Figure 7:
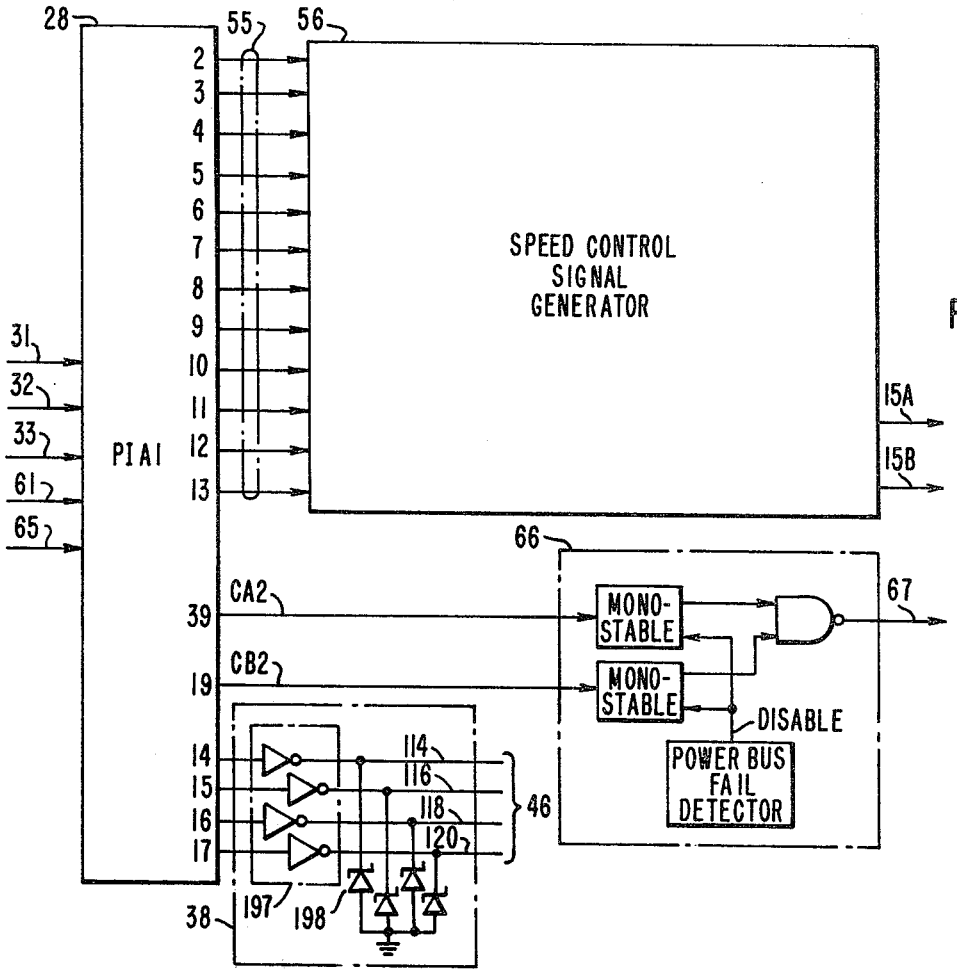
FIG. 7 is a schematic block diagram of a speed control signal generator, digital output and program malfunction detect interface unit for use in the system of FIG. 1.
Figure 9:
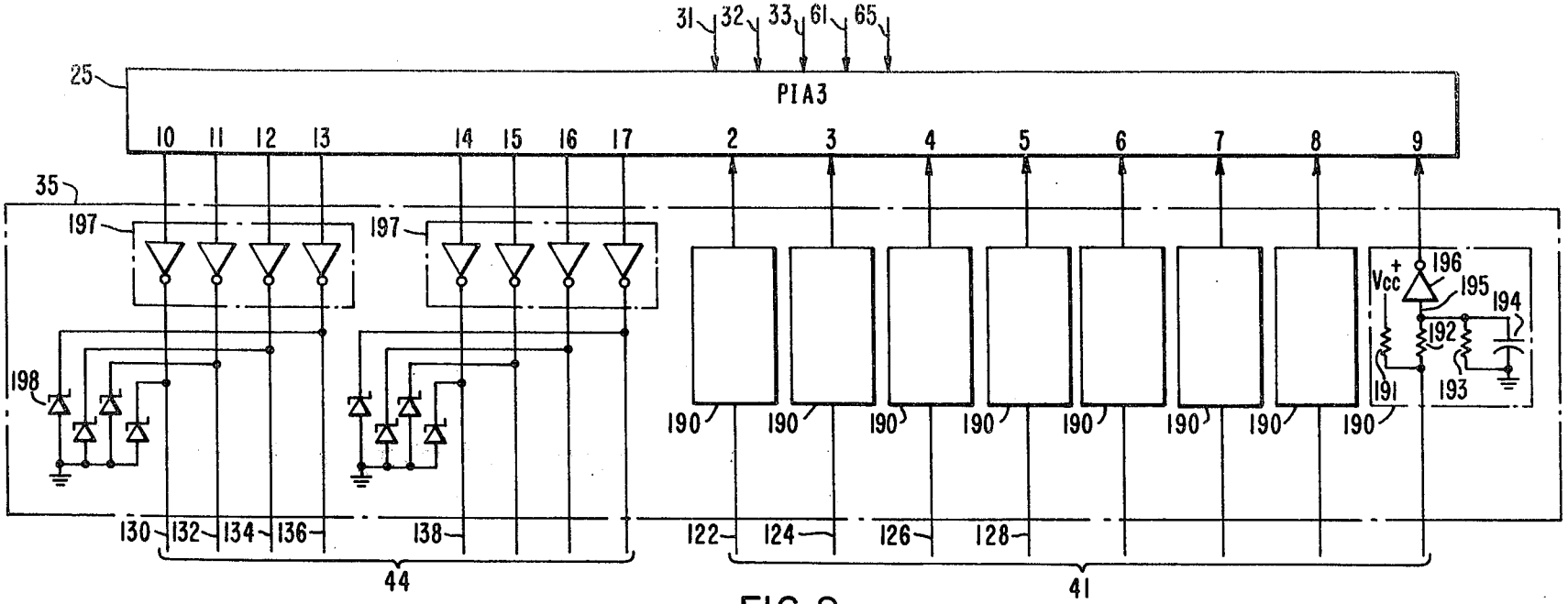
FIG. 9 is a schematic block diagram of a digital input and output interface unit for use in interfacing the panel and the speed controller of FIG. 1.

In FIG. 5, signal lines 110 and 112 respectively couple the pushbutton switches of PB1 and PB4 to the signal conditioning circuits 190 of bits 0 and 1 of the A side of the interface unit 27 as shown in FIG. 6. Signal line 114 and 116 respectively couple the speed demand and acceleration split lens backlight indicators of PB1 with the output driver circuits 197 of bits 4 and 5 of the B side of the interface unit 28 as shown in FIG. 7. Signal lines 118 and 120 respectively couple the actual speed and speed reference split lens backlight indicators of PB4 with the output buffer circuits 197 of bits 6 and 7 of the B side of interface circuit 28 as shown in FIG. 7. Signal lines 122, 124, 126 and 128 respectively couple the pushbutton switches of PB5, PB6, PB3 and PB2 to the signal conditioning input circuits 190 of the bits 0, 1, 2 and 3 of the A side of interface unit 25 as shown in FIG. 9. Also, signal lines 130, 132, 134 and 136 respectively coupled the backlight indicators of PB5, PB6, PB3 and PB2 to the output driver circuits 197 of bits 0, 1, 2 and 3 of the B side of interface unit 25 as shown in FIG. 9. Accordingly, signal line 138 couples the LED status lamp L1 with the output driver circuit 197 of bit 4 of the B side of interface unit 25. All of the backlight indicators of the pushbuttons are supplied power from $Vcc^+$. The LED status lamps are supplied power from $Vc^+$ through current limiting resistors R1, R2 and R3 associated therewith.

Figure 8:
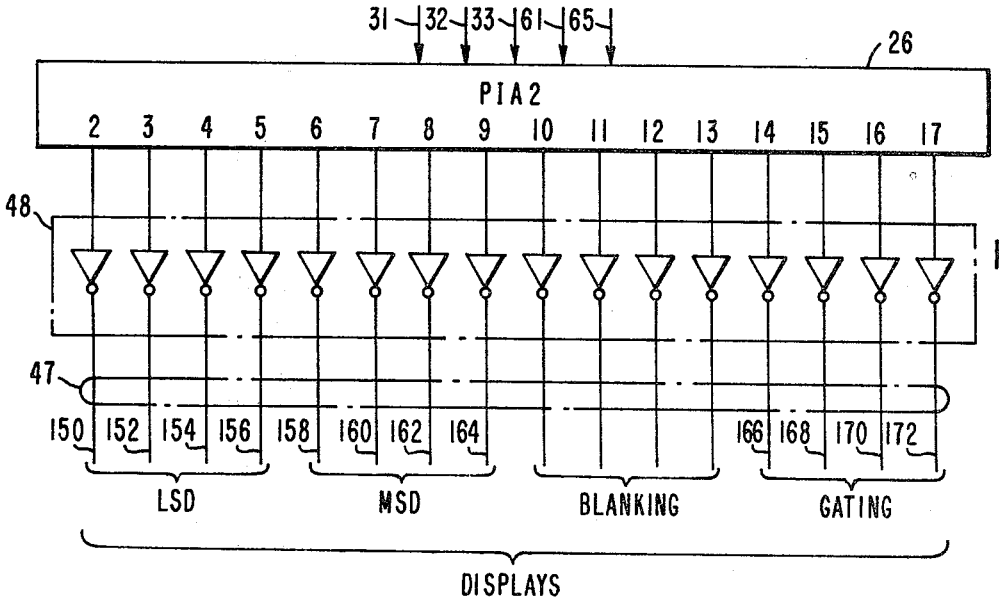
FIG. 8 is a schematic block diagram of a panel display driver interface unit for use in the system of FIG. 1.

Each adjacent two digits of window displays DP1 and DP2 enter display information from 8-bits of "bused" data supplied thereto in accordance with a strobed gate signal. More specifically, signal lines 150, 152, 154 and 156 respectively couple the binary coded decimal (BCD) data from the lower order digit of each of the adjacent sets of digits to the display drivers 48 of bits 0, 1, 2 and 3 of the A side of the interface unit 26 as shown in FIGS. 5 and 8. Also, signal lines 158, 160, 162 and 164 respectively couple the BCD data from the higher order digit of each of the adjacent sets of digits to the display drivers 48 of bits 4, 5, 6 and 7 of the A side of the interface unit 26. Gating signals 166, 168, 170 and 172 are respectively coupled from the display drivers 48 of bits 4, 5, 6 and 7 of the B side of interface unit 26 to adjacent displays 140–141, 142–143, 144–145 and 146–147.

Referring to FIG. 6, speed monitoring interface 54 functions to produce one or more speed data words from the input speed signal 14 during each period of the real time clock signal 62 ($\overline{\text{RTCINT}}$). For the purposes of this embodiment, the speed data word is 8 bits which are coupled in parallel to the interface unit 27 using bits 0 through 7 of the B side. Control of the speed monitoring interface 54 is performed using signal lines CA2 and CB2 coupled thereto from the interface unit 27. In addition, control line CA1 provides a signal to the interface unit 27 indicating that the speed data word register of 54 has exceeded a predetermined value. The operation of control lines CA1, CA2 and CB2 is conducted in response to a set of instructions stored in the PROM devices which may be executed once every period of the real time clock signal 62, for example. This operation is described in greater detail in the U.S. Patent application Ser. No. 771,141 previously referenced to hereinabove.

Interface unit 27 further monitors pushbutton status from the panel 16 over signal lines 110 and 112 and relay contact status from relay logic 1A over signal lines 100 and 104 as previously described above. In addition, interface unit 27 monitors the states of a set of switches 58 using the bits 4, 5, 6 and 7 of its B side. The application of the selection of a particular state of the switches 58 corresponds to a set of one time constant and one gain for use in a proportional plus integral closed-loop speed controller function characterized by the instructions preprogrammed in the PROM devices 19 through 22. This will become more apparent from the description of the program organization found herebelow.

Referring to FIG. 7, bits 4, 5, 6 and 7 of the B side of the interface unit 28 are used to drive the backlighted indicators located within the pushbuttons on panel 16 as previously described. The remaining 12 output bits of interface unit 28 make up the speed control signal data word 55 which is converted into an analog signal 15A with return line 15B using the speed control signal generator 56. A suitable range of the speed control signal 15A for the purposes of driving the torque motor 124 of the control fluid pressure system 7 was found to be 0 to 200 ma. The speed control signal generator 56 is similar to that described in U.S. Patent application Ser. No. 771,141, supra.

The program execution failure detect circuit 66 is controlled by the control lines CA2 and CB2 from the interface unit 28. CA2 and CB2 under operation of instructional code found in the PROMs 19 through 22 maintain a periodic triggering of two monostables correspondingly associated therewith. The monostables are enabled by a power supply malfunction detection circuit. Should either or both outputs of the two monostables go to a false state, signal line 67 will de-energize the DCS relay of the relay logic 1A. This circuitry is also similar to that described in U.S. Patent application Ser. No. 771,141.

The interface unit 26 of FIG. 8 is used to effect the control of the information entered into display windows DP1 and DP2 of the operator's panel 16 as previously described above. Also, interface unit 25 of FIG. 9 monitors the pushbutton switches of the operator's panel 16 using signal lines 122, 124, 126 and 128 and drives the backlighted indicators of the pushbuttons using signal lines 130, 132, 134, 136 and 138 as described above in connection with FIG. 5.

2. PROGRAM ORGANIZATION AND OPERATION

As has been described hereinabove in connection with FIG. 1, a number of read-only-memories are permanently pre-programmed with sets of digital instructions and data words in an addressable order for characterizing the operation of the speed control system depicted by FIG. 1. For the purpose of this embodiment, the instruction sets were developed using the Motorola M6800 assembly level language which is used herein to provide a greater detail of the invention for a better understanding and appreciation thereof. The address range of each of the PROM devices 19 through 22 are shown in the following table:

| PROM | Address Range (hexidecimal code) | | |
|---|---|---|---|
| 19 | F200 | through | F3FF |
| 20 | F600 | " | F7FF |
| 21 | FA00 | " | FBFF |
| 22 | FE00 | " | FFFF |

In using the Motorola M6800 assembly level language, it was found that approximately 1370 bytes of PROM storage was necessary. The storage arrangement for permanently programming the instruction and data words in the PROM devices used the addressed register locations from F600 through F7FF in PROM 20; FA00 through FB98 in PROM 21; and FE00 through FFBE, and FFFB through FFFF in PROM 22. PROM 19 was not programmed with instructions and data for this embodiment. An additional 48 bytes of the temporary storage device 23 from 0000 to 002F were also designated to store system variables.

A printout of the assembly level language program illustrating the addressable order in which it was preprogrammed into the PROMs 20, 21 and 22 is shown in Appendix B. A PROM burner such as the one manufactured by DATA I/O Corp. Model No. 2136D PROM burner was found suitable for permanently pre-programming the set of instructions and data in the PROM devices. The operation and organization of the programs will be provided in greater detail herebelow.

2.1 FUNCTIONAL FLOWCHART

Figure 10:
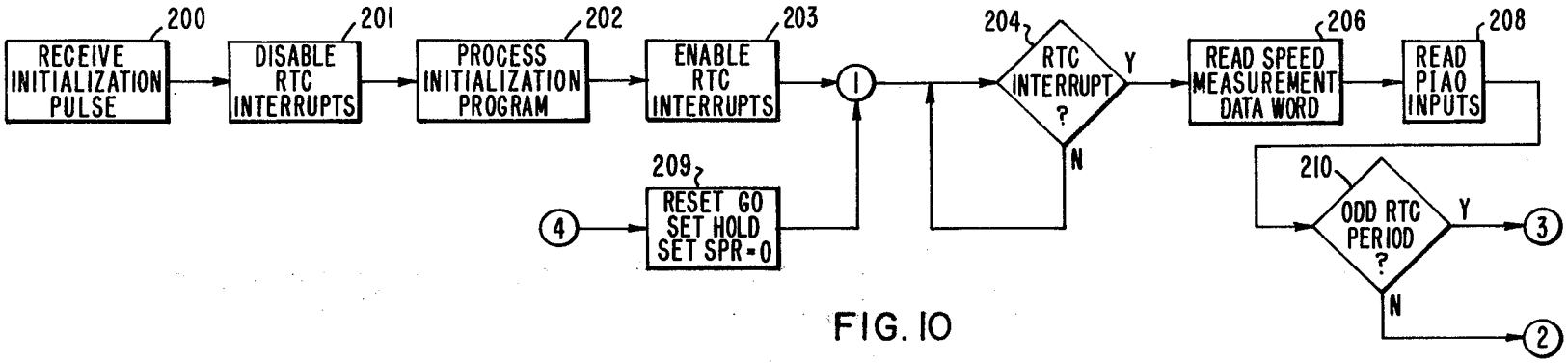

Referring to the flowcharts of FIG. 10, program processing begins at block 200 where the microprocessor 18 (see FIG. 1) receives the initialization signal 65 from circuit 64. Generally when power to the speed controller 1 is turned on, functional block 201 disables the microprocessor response to the real time clock (RTC) interrupts provided to it from the real time clock generator 60 via interface unit 27 and control lines 33. In block 202, the microprocessor 18 processes an initialization program to set a stack pointer to $007F, clear all registers in the temporary storage device 23 and initialize all the registers of the interface unit 25 through 28. Thereafter, the microprocessor 18 is enabled to respond to RTC interrupts in block 203. The previously described portion of the sets of instructions and data is executed only as governed by the initialization pulse over signal line 65, generally when power is turned on.

Figure 12:
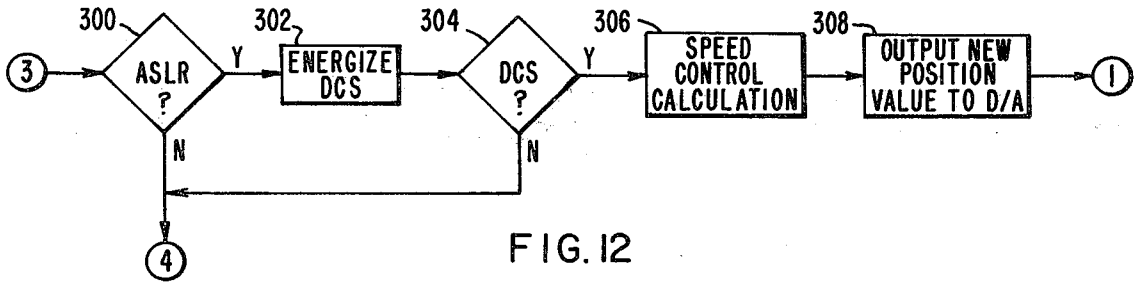
FIGS. 10, 11A, 11B and 12 are program flowcharts depicting a sequence in which the instructions and data words, pre-programmed in the read-only-memories, may be executed by the microprocessor of the speed controller of FIG. 1.
Figure 11A:
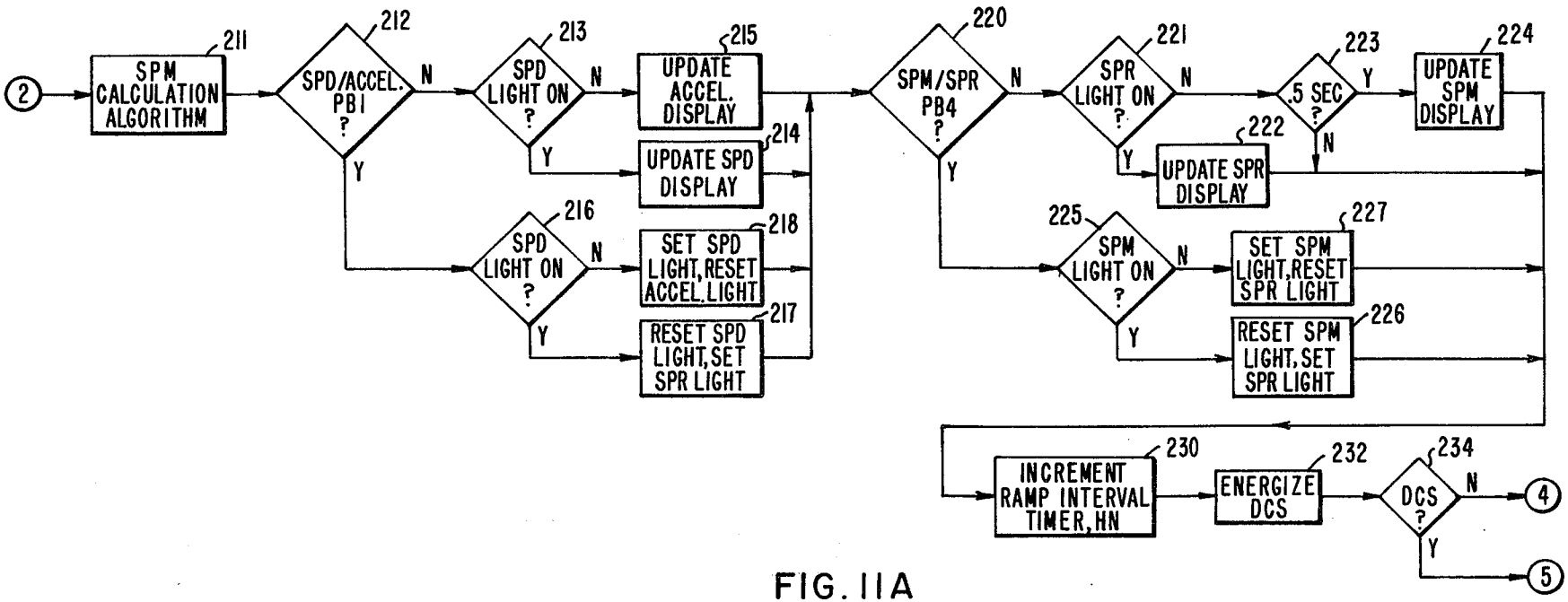
Figure 11B:
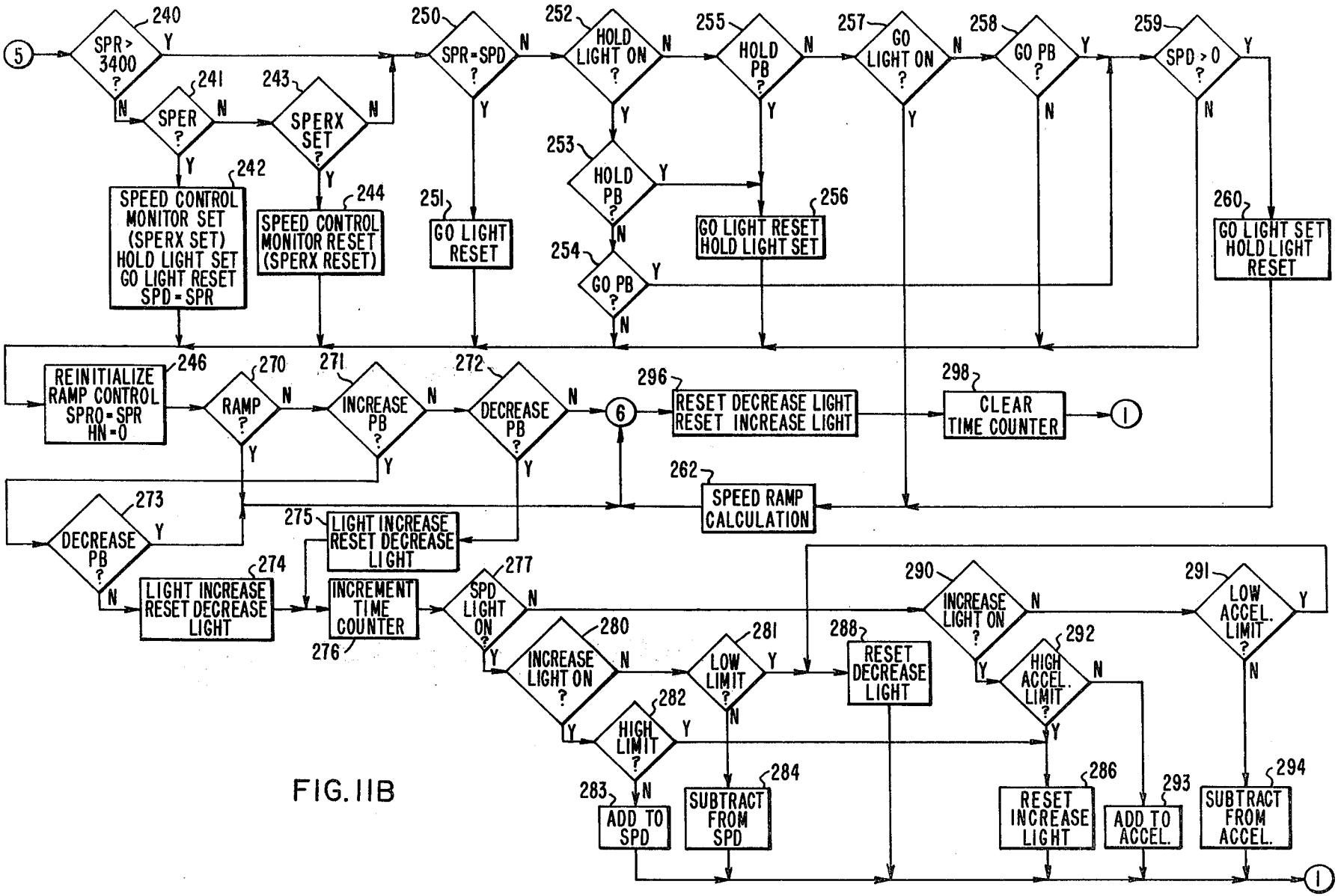

The decision block 204 essentially loops about itself until a RTC interrupt occurs. A RTC period of 64 Hz was found suitable for the purposes of this embodiment. Therefore, the portion of the instruction sets of programming following the interrupt loop are executed once every 1/64 second. Functional Block 206 reads the speed measurement data word from the speed monitoring interface 54 and stores it in a temporary storage location in device 23. In addition, the digital inputs of the B side of interface unit 27 (PIAO) are read into the microprocessor and stored in the stack of device 23 using functional block 208. The odd and even periods of the RTC signal 62 are determined by functional block 210 which further decides the processing flow therefrom. During an even period of the RTC signal 62, the functional flow diagrams depicted by FIGS. 11A and 11B are processed. During an odd period thereof, that depicted by FIG. 12 is processed.

Starting with FIG. 11A, functional block 211 calculates a new value of the measured speed during each even period of the RTC according to the following algorithm. The instant value of the measured speed is reduced by 1/16 of its value. The speed measurement data words produced by the speed monitoring interface unit 54 during the preceding two periods of the RTC are added to the reduced measured speed value. The result is the new measured speed value. This method produces an exponentially weighted average of the speed measurement data words produced by the speed monitoring interface 54. In the present embodiment, the calculations may be carried out to 24 bits or 3 bytes of storage in device 23 to maintain a 16 bit accuracy. A ¼ RPM resolution is thus achieved with a ½ second response time to change in the actual speed. If an overflow condition should occur during the calculations of block 211, the program stops all processing activity and waits for the malfunction detection circuitry 66 to time out and deenergize the DCS relay in relay logic 2A.

Accordingly, functional block 212 monitors the depression of PB1 on panel 16. If the PB1 has not been depressed, the appropriate display information is provided to window display DP2 of panel 16 in accordance with the status of the backlighting of PB1 using blocks 213, 214 and 215. Otherwise, the backlighting of the lamp requested by the instant depression of PB1 is accomplished with functional blocks 216, 217 and 218 and the window displayed undating is bypassed during the instant execution period. Decisional block 220 monitors the depression of PB4 in panel 16. If PB4 has not been depressed, the appropriate display information is provided to window display DP1 of panel 16 in accordance with the backlighting of the PB4 using blocks 221, 222 and 224. Functional block 223 accomplishes a display filtering effect by updating the speed measurement display only once every fraction of a second. A 0.5 second display update was found preferable. If PB4 has been depressed, the appropriate lamp in PB4 is backlighted as requested by the instant depression of PB4 using functional blocks 225, 226 and 227.

A ramp interval timer, HN, used as one method for increasing the speed reference value to the speed demand value at the desired acceleration, is incremented in functional block 230. An attempt to energize the DCS relay, shown in FIG. 2, is performed by 232 which is similar to that of the malfunction detection circuit 66 described in greater detail in the referenced U.S. application, Ser. No. 771,141. The energization of the DCS relay is monitored by block 234. If DCS relay is not energized, the flag bit which is used to backlight the GO lamp of PB6 is set false and the flag bit which is used to backlight the HOLD lamp of PB5 is set true and the speed reference (SPR) value is set equal to zero by block 209. The program processing is returned to the wait for interrupt loop at point ① and the next interrupt execution. If the DCS relay is energized, processing continues at block 240.

Functional blocks 240, 241, 242, 243 and 244 of FIG. 11B identify that a speed error beyond a predetermined value exists and accomplishes the associated action in response thereto. The predetermined speed error value found suitable for this embodiment is 300 RPM. More specifically, block 240 compares the instant SPR value with a value, typically 3400 RPM. If SPR is greater than 3400 RPM, functions 241 through 244 are bypassed and execution continues at block 250. Otherwise, speed error is monitored by 241. If greater than RPM, the following is performed in block 242: the flag for lighting the speed control monitor lamp, L1, is set true, the flags to backlight the lamp for pushbuttons, PB5 and PB6, are set respectively true and false and the speed demand is set equal to the instant speed reference. Otherwise, the speed control monitor lamp, L1, is monitored by 243. If the lamp L1 is illuminated, block 244 sets the flag for illuminating lamp L1 false and the program processing continues at block 246 which will be described herebelow. Else, program processing continues at block 250.

Functional block 250 compares the speed demand (SPD) with the instant speed reference (SPR) and if equal, block 251 sets the flag which backlights the PB6 false and continues execution at 246. IF SPR is not equal to SPD, the functional blocks 250 through 260 are executed to essentially perform the logic for: (a) interrupting the ramping of the speed reference with a HOLD function in response to depression of the HOLD pushbutton PB5 while in the GO mode and backlighting the appropriate pushbutton lamps, PB5 and PB6, and (b) restarting the ramping of the speed reference with a GO function in response to the depression of the GO pushbutton PB6 while in the HOLD mode and backlighting the appropriate pushbutton lamps, PB5 and PB6. If in the HOLD mode, program execution continues at block 246 and if in the GO mode, execution continues at block 262. More specifically, blocks 259 and 260 ensure that a value of the speed demand (SPD) greater than zero has been entered through panel 16 before the GO mode may be executed.

In functional block 262, a calculation shown in equation 2 below is performed to increment the speed reference value to the desired speed demand value at the desired acceleration value. The desired values of speed demand and acceleration being that which has been entered through panel 16 in accordance with equation (1) above will be described in greater detail herebelow.

$$SPR = \frac{a \cdot HN}{1920} + SPR_o \qquad (2)$$

wherein a = acceleration desired in RPM per minute.

HN = accumulated count in the ramp interval timer incremental every 1/32 second in block 230 shown in FIG. 11A.

1920 = conversion factor for converting counts based on 1/32 second to counts per minute (i.e. 32 counts/sec. × 60 sec./min. = 1920 counts/min.)

$SPR_o$ = starting value of speed reference at time HN = 0.

Also, $SPR_o$ may be set to the instant value of the speed reference and HN may be set to zero every time the acceleration changes sign or magnitude of the ramp interval timer, HN, overflows or when SPR is to be maintained constant, for example. This function is performed by block 246. The program execution continues, after functional block 262, at point ⑥ in the flowchart.

After performing the ramp reinitialization in functional block 246, the speed reference is monitored in block 270. If the speed reference is ramping to the speed demand, the program is next processed at ⑥, else the decrease pushbutton and increase pushbutton, PB2 and PB3, respectively are monitored in blocks 271, 272 and 273. Decisional block 273 protects against the case in which both pushbuttons PB2 and PB3 are depressed concurrently in which event further responsive program processing is aborted to point ⑥. If PB3 is depressed, its lamp is backlighted by block 274. If PB2 is depressed, its lamp is backlighted by block 275. A time counter associated with incrementing or decrementing the speed demand and acceleration in window DP2 is incremented or decremented in block 276 in accordance with the time that either pushbutton PB2 or PB3 is depressed. The variable, speed demand or acceleration, to be changed in value is determined by monitoring the lamps in pushbutton PB1 using decisional block 277. The time counter of block 276 is accumulating the number which is to be added to or subtracted from the selected variable in DP2 for each second the pushbutton PB2 or PB3 is depressed. In either case, it must next be determined whether to add to or subtract the accumulation of the time counter displayed in DP2 in accordance with the equation 1 shown hereinabove.

Blocks 280 through 284 check the instant speed demand variable against predetermined high and low limits and add or substract the value of the time counter in 276 respectively thereto or therefrom. If a high limit, for example 3800 RPM, has been reached, the increase lamp will be turned off by block 286. Also, if a low limit, for example 0 RPM, has been reached, the decrease lamp will be turned off by block 288. In either case, the program processing will be unresponsive to the depression of PB2 or PB3, as the case may be, to further change the value of the speed demand should its high limit or low limit be attained.

Blocks 290 through 294 check the instant acceleration variable against predetermined high and low limits and add or substract the value of the time counter in 276 respectively, thereto or therefrom. If a high limit value, for example 1000 RPM per minute, has been reached, the increase lamp will be turned off by block 286 and accordingly, if the low limit, for example 0 RPM per minute, has been reached, the decrease lamp will be turned off by block 288. In either case, the program processing will be unresponsive to the depression of PB2 or PB3, as the case may be, to further change the value of the acceleration should its high or low limit be attained.

When neither pushbutton is found depressed during the instant execution of blocks 271 and 272, processing is continued at point 6 of FIG. 11B where the flags for backlighting the lamps of PB2 and PB3 are set false in 296 and the time counter, incremented by 276, is cleared to zero in block 298. Program processing is then reverted to point 1 of FIG. 10 which is a wait for interrupt loop.

During odd periods of the real time clock, RTC, as determined by the decisional block 210 in FIG. 10, the portion of the program shown in FIG. 12 is executed. In block 300, the status of the ASLR relay is tested. If the ASLR relay is de-energized, no further program processing will be performed, block 209 will be executed and the microprocessor 18 will wait for the next interrupt. If the ASLR relay is energized, an attempt will be made to energize the DCS relay in 302 and if the DCS is not yet energized as determined by decisional block 304, program processing will be branched back to point 1 via block 209. If the DCS is energized, a speed control algorithm will be processed at block 306.

The speed control algorithm implements a proportional plus integral control function whose output, $V_j$, is best represented by an equation (3) shown below:

$$V_j = k_p \cdot E_j + k_I \cdot \sum_{i=0}^{j} E_i \quad j = 0, 1, 2, \ldots \tag{3}$$

where $k_p$ = proportional gain constant.

$k_I$ = integral gain constant which is representative of the integral time constant.

$E_j$ = speed error between the speed reference and speed measured values during the $j^{th}$ execution of the speed control algorithm which is normally executed 32 times per second.

The set of four SPST switches 58 connected to the A side of interface unit 27 (see FIG. 6) represents a binary code which allows the selection of one of sixteen proportional and integral gain pairs — ($k_p0$, $k_I0$),....., ($k_p15$, $k_I15$) — which are pre-programmed in the PROM devices and used in the speed control algorithm as shown in equation (3) above. Internal to the program, the gain constants may be represented as the ratio of two integers. For example, the denominator, $k_{pd}$, of the proportional gain is fixed while the numerator is, $k_{pn}$, of the integral gain is fixed, while the denominator, $k_{Id}$, is selected by the binary switch 58. Typical examples of proportional gains and integral time constants found suitable for the present embodiment are shown in the table below:

| Binary Number of 58 | Proportional Gain | Reset time (sec) |
|---|---|---|
| 0000 | 25 | 1.0 |
| 0001 | 25 | 1.6 |
| 0010 | 25 | 2.0 |
| 0011 | 25 | 2.4 |
| 0100 | 25 | 2.8 |
| 0101 | 20 | 1.0 |
| 0110 | 20 | 1.4 |
| 0111 | 20 | 1.8 |
| 1000 | 20 | 2.0 |
| 1001 | 20 | 2.4 |
| 1010 | 20 | 2.8 |
| 1011 | 20 | 3.0 |
| 1100 | 14 | 1.4 |
| 1101 | 14 | 1.8 |
| 1110 | 14 | 2.2 |
| 1111 | 14 | 2.8 |

The result, $V_j$, of equation (3) is representative of the valve position update value converted to the speed control signal 15A and 15B by the speed control signal generators 56 as shown in FIG. 7.

The value, $V_j$, is conditioned and transferred to the converter of 56 by the instructional block 308. The value of $V_j$ is limited to positive numbers any result which is negative is set equal to zero prior to being transferred to converter 56.

2.2 SUBROUTINES

The program functionally described above includes both a main section and a number of subroutines disposed therethrough. The subroutines rendered a reduction in the amount of redundant programming substantially. The first of the subroutines are designated MAD1 and MAD2 which perform the operation represented by the equation (4) below:

$$R = (X/Y)*Z \quad (4)$$

Subroutines MAD1 and MAD2 divide a 16 bit positive integer, X, by a 16 bit positive integer, Y, and multiply the quotient by a 16 bit positive integer, Z. The result, R, is a signed 32 bit number having a 16 bit integer part and a 16 bit fraction part. The sign of the result is positive if the most significant bit of memory location designated as TEMP1 in device 23 is zero. Otherwise, the result is negative.

Input: (MAD1) The addresses of Y and Z are stored immediately after the subroutine call as can be seen in the printouts of the program in Appendix B.

Instructional calling sequence:

JSR MAD1
address of Y
address of Z

The address of X must be loaded into the index register of microprocessor 18 prior to the subroutine call.

(MAD2) The addresses of X and Z are stored after the subroutine call and the address of Y is loaded into the index register.

Instructional calling sequence:

JSR MAD2
address of X
address of Z

Output: The signed 32 bit result is stored in 4 consecutive bytes of memory starting at a location designated as SCPDR in device 23. The integer part of the result is loaded into accumulators A (most significant byte) and B of microprocessor 18. If an overflow occurs the largest positive (or negative) number is returned as the result. The content of the index register is preserved.

Memory Used: 214 bytes of program memory and 11 bytes of temporary storage including the four byte result. Additional memory is also required for the input integers X, Y, and Z and the sign flag at TEMP1 in device 23.

Execution Time: Execution time is a function of the values of X, Y, Z, and TEMP1. The worst case time is less than 5200 clock cycles and the typical execution time is 4160 clock cycles of the system clock 60.

Another subroutine, BCD, converts a 16 bit positive binary integer into a 4 digit BCD number and sends the result to one of the two panel displays, DP1 and DP2.

Input: The address of the 16 bit integer must be loaded into the index register prior to the subroutine call. If the result is to be sent to the speed reference/-measured speed display, a hexadecimal E8 must be stored in a memory location designated as TEMP2 in device 23. If the result is to be sent to the speed demand-/acceleration display, B8 must be stored in TEMP2.

Output: The four BCD digits are sent to the appropriate display, DP1 or DP2, and are stored in memory locations designated as BCDH (most significant digits) and BCDL in device 23. If an overflow occurs a hexidecimal 9FFF is sent to the display, blanking the last three digits. The content of the index register is preserved, but the contents of the two accumulators of microprocessor 18 are destroyed.

Memory Used: 54 bytes of program storage and 3 bytes of RAM storage. Additional memory is required for the peripheral interface adapter (PIA) used as the output port for the decimal displays.

Execution Time: Execution time is a function of the value of the number to be converted. If the sum of the digits in the result is N, then the execution time is [676 + 22N] clock cycles of the system clock 60.

Yet another subroutine, DADD, adds a 16 bit word in memory to the 16 bit word contained in accumulators A (most significant byte) and B of the microprocessor 18 and stores the result in temporary storage device 23.

Input: The address of the word to be added to A and B must be loaded into the index register of microprocessor 18.

Output: The result of the summation is in accumulators A and B and the memory addressed by the index register. If an overflow occurs A and B contain the largest positive (7FFF) or smallest negative (8000) number. The contents of the index register are preserved.

Memory Used: 22 bytes of program storage plus 2 bytes of temporary memory for the result.

Execution Time: 31 clock cycles of the system clock 60 if no overflow occurs, 39 clock cycles if negative overflow occurs, and 43 clock cycles if positive overflow occurs.

Still another subroutine, LIGHT, turns the front panel 16 HOLD, GO, INCREASE, DECREASE or SPEED CONTROL MONITOR lights on or off according to the contents of accumulators A and B of microprocessor 18.

Input: Accumulator A is loaded with a "1" at each bit position corresponding to the light that is to be turned on. Accumulator B is loaded with a "0" at each bit position corresponding to the light that is to be turned off.

Output: The lights are turned on or off as described above. If an attempt is made to turn a light on and off during the same subroutine call, the off condition will dominate. The contents of the accumulators are destroyed.

Memory Used: 12 bytes of program storage, 1 byte of temporary storage (TEMP2), and the memory required by PIA-3 (used to control the lamp drivers).

Execution Time: 21 clock cycles of the system clock 60.

A final subroutine, RMPST, transfers the current speed reference value (SPR) to the initial speed reference value (SPRO) and clears the 16 bit time counter (HN) in accordance with the functional block 246 of FIG. 11B.

Input: None.

Output: The contents of accumulators A and B of microprocessor 18 are destroyed.

Memory Used: 15 bytes of program storage plus 6 bytes of temporary storage containing SPR, SPRO, and HN.

Executtion Time: 29 clock cycles of system clock 60.

2.3 PROGRAM ORGANIZATION

An assembled listing of the programmed instructions for performing the functions of the flowcharts depicted in FIGS. 10, 11A, 11B and 12 is found in Appendix B. These instructions and data have been permanently preprogrammed in the PROM devices 20, 21 and 22 in accordance with speed control system characterization of the present embodiment. The organization of the instructions and data as programmed in the PROM devices is best presented in the form of PROM Maps which are shown below:

MAP OF PROM 200 (F600-F7FF)

| Address Range | Function |
|---|---|
| F600-F632 | (a) Test Interrupt.<br>(b) Read in Speed Measurement Data Words from unit 54.<br>(c) Halt Programming upon detected malfunction.<br>(d) Scan A side inputs of interface unit 27 and store in stack. |
| F633-F642 | (a) Decrement display counter with each RTC interrupt occurrence.<br>(b) Test for odd/even RTC periods. |
| F643-F684 | Speed measurement calculation algorithm. |
| F685-F6F0 | (a) Panel display pushbutton logic, PB1 and PB4.<br>(b) Update panel displays, DP1 and DP2. |
| F6F1-F6FD | Increment ramp internal timer. |
| F6FE-F700 | Jump to PROM2 FA00 |
| F701-F79D | (a) Check DCS and ASLR relays.<br>(b) Perform Speed Control Calculation<br>(c) Output to Speed Control Data Word Converter in unit 56<br>(d) Return to interrupt loop. |
| F79E-F7B3 | DADD Subroutine. |
| F7B4-F7B9 | Load accumulator B with display pushbuttons and jump to PROM2. |
| F7BA-F7FF | Table of proportional and integral gain constants. |

MAP OF PROM 21 (FA00-FBFF)

| Address Range | Function |
|---|---|
| FA00-FA0D | (a) Clear speed reference value.<br>(b) Set Hold, reset GO functions<br>(c) Return to interrupt loop. |
| FA0E-FB87 | (a) Attempt to energize DCS relay.<br>(b) Test DCS relay.<br>(c) Return to interrupt loop. |
| FB88-FB92 | LIGHT Subroutine |
| FB93-FB98 | DATA |
| FB99-FBFF | EMPTY |

MAP OF PROM 22 (FE00-FFFF)

| Address Range | Function |
|---|---|
| FE00-FE53 | Initialization instructions. |
| FE54-FE56 | Wait for interrupt loop. |
| FE57-FE63 | More Initialization instructions. |
| FE64-FF39 | MAD1 and MAD2 Subroutines. |
| FF3A-FFBE | BCD Subroutine |
| FFBF-FFF7 | EMPTY |
| FFF8-FFFF | Interrupt Vector Addresses |

To more fully understand the program listing of Appendix B, a dictionary of labels and symbols is presented in Appendix A to be reference during the perusal of the program listing of Appendix B.

3. TYPICAL OPERATION OF THE SPEED CONTROL SYSTEM

The typical operation of the speed control system embodiment described in connection with FIG. 1 herein follows. The hydraulic fluid used for operating the valve servomotors 6 is brought to a pressure above the operational level and the ASL becomes true to energize the ASLR relay of relay logic 2A. The PROM devices 20, 21 and 22 are permanently pre-programmed with a plurality of sets of instructions and data words and are inserted into their corresponding locations in the speed controller 1. Power is turned on and the initialization pulse is conducted to the microprocessor 18 which in turn, executes the intialization portion of the programmed instructions and data contained in the PROM devices. After initialization, a wait for RTC interrupt loop is processed until a RTC interrupt occurs. Thereafter, the remaining portion of programming is executed once every 1/64 second at the occurrence of a RTC interrupt.

Two subportions of the remaining program are alternately executed during respective alternate odd and even RTC periods. That subportion associated primarily with panel operation is executed during the even periods of the RTC and that subportion associated primarily with the speed control functions is executed during the odd periods of the RTC, for example.

During the initial operation of the speed controller 1 prior to any panel commands, the status of the turbine system 2 will be established, the DCS relay will be energized, the operator's panel will be updated and the speed measurement value will be calculated. Also during this initial period a speed control signal 15A and 15B having a value substantially close to ground potential will be generated by unit 56. The plant operator may enter a speed demand and acceleration value using the window display, DP2, and pushbuttons PB1, PB2 and PB3 of panel 16. The speed reference may be accelerated to the entered speed demand value at the entered acceleration value upon depressing the GO pushbutton PB6. The speed of the turbine 2 will be controlled to track the speed reference in accordance with the proportional plus integral closed-loop control function programmed in the PROM devices and executed by the microprocessor 18 utilizing the valve servomotors 6 to admit steam from the source 4 to the turbine 3. The values of the reference or measured speed may be monitored through display window DP1 as selected by the state of pushbutton PB4. The speed reference acceleration may be inhibited at any time by depressing the HOLD pushbutton PB5. All pushbuttons are backlighted during the activation of their function by the microprocessor 18. The speed reference acceleration may be restarted by again depressing the GO pushbutton PB6. The speed reference may be ramped to a number of preselected speed demand values at various accelerations until a final turbine speed is achieved.

If a malfunction in speed controller operation should occur, the DCS relay will de-energize due to the loss of signal 67 which, in turn, will cause the valve servomotors 6 to close by zeroing the signal to the torque motor 124 in the control fluid pressure system 7. Control of the valve servomotors 6 may be performed manually by transferring modulation of fluid pressure signal 7A to the manual cup valve assembly 112 of system 7.

APPENDIX A
SYMBOL AND LABEL DICTIONARY

| NAME | DESCRIPTION | BYTES | BRANCH POINT | VALUE | PAGE ADDR |
|---|---|---|---|---|---|
| ACCEL | Acceleration | 2 | | | $09 |
| ACLHG | Upper Limit On Acceleration | 2 | | 1000 | |
| ACLLW | Lower Limit On Acceleration | 2 | | 0 | |
| ACSPB | Control Of The Initial Latch Clock Setting For Accel And Demand Display (see SMSRB) | 1 | | $B8 | |
| ADDD | Branch Point For Add In MAD Subr | | 8004 | | |
| ADRMP | Branch Point For Setting New Sign Flag In Ramp Calculation | | 7DF8 | | |
| BASL | Mask Used To Test ASL Contact Input | 1 | | $04 | |
| BCD | Starting Addr Of Binary-To-BCD Subr | | 8075 | | |
| BCDH | Addr Of Upper 2 BCD Digits | 1 | | | $19 |
| BCDL | Addr Of Lower 2 BCD Digits | 1 | | | $1A |
| BCDLP | Addr To Begin BCD Algorithm Looping | | 80AA | | |
| BDCS | Mask Used To Test For DCS Relay Energized | | | 8 | |
| BEGIN | Branch Point To Check ASL Contact | | 7D53 | | |
| BIDLF | Value Of Constant | 1 | | $F3 | |
| BILTN | Value Of Constant | 1 | | $4 | |
| BLSPD | Value Of Constant | 1 | | $10 | |
| BSDLT | Mask Used To Determine State Of Toggle PB's | 1 | | $10 | |
| BSRLT | Mask Used To Determine State Of Toggle PB's | 1 | | $80 | |
| C103 | Value Of Constant For BCD Subr | 2 | | 1000 | |
| C104 | Value of Constant For BCD Subr | 2 | | 10000 | |
| C300 | Value Of Constant For Speed Error | 2 | | 300*4 | |
| C3400 | Value Of Constant For Speed Error | 2 | | 3400*4 | |
| C3840 | Value Of Constant For Speed Ramp Calc | 2 | | 3840/2 | |
| CBMON | Mask To Clear Speed Monitor | 1 | | $EF | |
| CON1 | Branch Pt If INTER Is Positive | | 7F65 | | |
| CONTL | Branch Point To Reset Ramp Function | | 7E38 | | |
| COUNT | Address Of Counter Used In Binary-To-BCD Routing And MAD Routines | 1 | | | $2A |
| D1 | Branch Points Jump To BCD Subroutine | | 7D1E | | |
| D2 | Branch Points Jump To BCD Subroutine | | 7D43 | | |
| DADD | Address Of Starting Point For Double Precision ADD Subroutine For PI Controller KP*E + KI* SUM(E) | | 7F89 | | |
| DAOUT | Branch Point To Start Of D/A Conv Output | | 7F75 | | |
| DECR | Branch Point For INCR Light Off | | 7EBA | | |
| DELTA | Branch Point To Update ACCEL Or DEMAND Values | | 7E68 | | |
| DEXIT | Branch Point Exit Out Of DADD Subroutine | | 7F9A | | |
| DIGIT | Branch Point To Add 1000 In BCD Routine | | 80B7 | | |
| DISPB | Address Of Panel Scan Logical Variables Of The Display Select PB's For DEM/ACCEL and MEAS/REF SPEED | 1 | | | $2C |
| DISUP | Address Of Display Update Counter | 1 | | | $2B |
| ENDAD | Branch Point For End Of Addition In BCD Subroutine | | 8033 | | |
| EQUAL | Branch Point To Set GO Light Off | | 7E33 | | |
| ERROR | Branch Point To Set SPD To SPR | | 7DA3 | | |
| EVEN | Branch Point For EVEN Parity | | 7D0E | | |
| EXIT | Branch Point Out Of INCR/DECR Subroutine | | 7ECF | | |
| GLTOF | Branch Point To Test GO PB | | 7E09 | | |
| GO | Branch Point To Energize DCS Relay | | 7D61 | | |
| GOLTF | Mask To Turn GO Light Off | 1 | | $FD | |
| GOLTN | Mask To Turn GO Light Out | 1 | | $02 | |
| HDLTF | Mask To Turn HOLD Light Off | 1 | | $FE | |
| HDLTN | Mask To Turn HOLD Light On | 1 | | $01 | |
| HLTON | Branch Point To Test HOLD PB | | 7E29 | | |
| HN | Address Of 16 Bit Counter | 2 | | | $0D |

-continued

APPENDIX A
SYMBOL AND LABEL DICTIONARY

| NAME | DESCRIPTION | BYTES | BRANCH POINT | VALUE | PAGE ADDR |
|---|---|---|---|---|---|
| | Which Counts When Ramping Used In MAD Routine During Ramp (ΔSPR = ACCEL* HN/ C3840) | | | | |
| HPBON | Branch Point To HOLD PB On True | | 7E31 | | |
| IDMSK | Mask For INCR, DECR PB's | 1 | | $0C | |
| INCDC | Branch Point To INCR/DECR Test | | 7E3A | | |
| INCRM | Branch Point To Compute Incremental Ramp | | 7DE3 | | |
| INCVL | Address Of 16 Bit Variable To Be Added To Appropriate Display During INCR and DECR PB Depression (ACCEL or DEMAND) | 2 | | | $0B |
| INILZ | Branch Point To Initialize PIA's | | 7C1D | | |
| INIT | Address Of Initilization Flag (Zero Indicates Flag Set) | 1 | | | $2D |
| INLP1 | Branch Point To Loop In PIAST | | 7C4A | | |
| INT | Address To Start Interrupt Service Routine | | 7C55 | | |
| INTER | Address Of Integral Portion OF P+I Controller Output | 4 | | | $15 |
| LIGHT | Branch Point To Start Subr Which Turns Panel Lights On And Off | | 7EDB | | |
| LIMIT | Branch Point To Start Subr Which Adds Or Subtracts INCVL From Demander Accel and Checks If It Exceeds Limits | | 7E8B | | |
| LTERR | Branch Point For Error In Parity Check | | 7D02 | | |
| MAD1 | Branch Point To Start Of Multiply/Divide subr 1 | | 7FB1 | | |
| MAD1A | Branch Point To Load Numerator | | 7FB4 | | |
| MAD2 | Multiply/Divide Subr 2 | | 7F9F | | |
| MADM | Branch Point To Load Multiplier Address In MAD Subroutines | | 7FCB | | |
| MDLOP | Branch Point In MAD To Start Multiply/Divide Algorithm | | 7FE8 | | |
| MEXIT | Branch Point In MAD To Store Result In SCPDR | | 805E | | |
| MONLT | Mask To Turn On Speed Error And HOLD Lights | 1 | | $11 | |
| MPY10 | Branch Point In BCD To Start Multiply by 10 routine | | 809C | | |
| NEGOV | Branch Point To D/A Conv Negative Overflow | | 7F97 | | |
| NOADD | Branch Point In MAD If No Addition Is Required During Algorithm | | 8038 | | |
| NORLY | Branch Point If DCS Relay Is De-Energized | | 7D59 | | |
| NOTEQ | Branch Point When SPR & SPD Not Equal | | 7DBC | | |
| NOTNE | Branch Point When Output Of D/A Conv is not negative | | 7F6F | | |
| NRLY | Branch Point To NORLY | | 7EF3 | | |
| ODDCK | Branch Point For ODD Parity | | 7D00 | | |
| OUTER | Address Of Value Calculated In PI Algorithm Sent To D/A Conv | 2 | | | $13 |
| OUTRG | Branch Point When SPD Or ACCEL Is Out Of Range | | 7EA6 | | |
| OV1 | Branch Point When GO PB ON And SPD > 0 Is True | | 7E22 | | |
| OV2 | Branch Point When GO PB ON And SPD > If False | | 7E16 | | |
| OVER | Branch Point In MAD Used To Adjust Stock | | 8066 | | |
| OVER1 | Branch Point In MAD If Overflow Adjusts Stock | | 8065 | | |
| OVFL | Branch Point In BCD For Positive Overflow | | 80D3 | | |
| OVTST | Branch Point To Test for Display Overflow In BCD Subroutine | | 808C | | |
| PARCK | Branch Point To Check Parity Of Display PB's | | 7CF7 | | |
| PBOFF | Branch Point When INC Or DEC PB Off | | 7E4A | | |
| PBONN | Branch Point When INC Or | | 7E59 | | |

-continued

APPENDIX A
SYMBOL AND LABEL DICTIONARY

| NAME | DESCRIPTION | BYTES | BRANCH POINT | VALUE | PAGE ADDR |
|---|---|---|---|---|---|
| | DEC PB On | | | | |
| PDCSA | Address Of Control Register A Of PIA 1 | 1 | | | $105 |
| PDCSB | Address Of Control Register B Of PIA 1 | 1 | | | $107 |
| PIAST | Branch Point To Set IA Data Direction Registers | | 7C48 | | |
| PIBUT | Address Of PIA Peripheral Register Associated With HOLD, GO, INCR, DECR PB's | 1 | | | $010C |
| PIDAH | Address Of PIA Peripheral Register For Higher Order 8 Bits Of D/A Converter | 1 | | | $104 |
| PIDAL | Address Of PIA Peripheral Register For Lower Order 4 Bits Of D/A Converter | ½ | | | $106 |
| PIDCN | Address of PIA Peripheral Register Used For Latching And Blanking Displays | 1 | | | $010A |
| PIDHT | Address Of PIA Peripheral Register Containing Display Information Associated With SPM/SPR AND APD/ACCEL Lamps (4 Bits) | ½ | | | $106 |
| PIDIS | Address Of PIA Peripheral Register used For Display Information | 1 | | | $0108 |
| PIDLT | Address Of PIA Peripheral Register Containing Display Information Associated With SPM/SPR And SPD/ACCEL Lamps (4 Bits) | ½ | | | $106 |
| PIDPY | Branch Point In BCD To Display BCD Informatin | | 80DB | | |
| PILIT | Address Of PIA Peripheral Register Containing Display Informaton Associated With The GO, HOLD, INCR, DECR And SPEED ERROR Lamps | 1 | | | $10E |
| PIOCA | Address of PIAO Control Register A Side | 1 | | | $0101 |
| PIOCB | Address of PIAO Control Register B Side | 1 | | | $0103 |
| PIOPA | Address Of PIAO Peripheral Register A Side | 1 | | | $0100 |
| PIOPB | Address Of PIAO Peripheral Register B Side | 1 | | | $0102 |
| PIRLY | Address Of Peripheral Register A Of PIAO | | | | $100 |
| RAMP | Branch Point To Compare SPD To SPR | | 7DCB | | |
| RANGE | Branch Point INCR/DECR Adj In Range | | 7ECE | | A40C |
| RMPST | Address Of Subroutine which Resets HN To Zero And Equates New Speed Ref To Old Speed Ref | | 7DFB | | A33C |
| RTCEN | Mask To Set Control Register B Of PIA0 | 1 | | $27 | |
| RTCIN | Branch Point For Real Time Clock Entry | | 7C70 | | |
| SCPDD | Address Of Denominator Used In Multiply/Divide Subroutines | 2 | | | $1D |
| SCPDN | Address Of Numerator Used In Multiply/Divide Subroutines | 2 | | | $1B |
| SCPDR | Address Of Result From Multiply/ Divide Subroutines | 4 | | | $1F |
| SCPDX | Address | 2 | | | 23 |
| SETC | Branch Point For Setting Carry In MAD Program | | 8001 | | |
| SFLP | Branch Point For Shifting Digits From Low To High Registers | | 80C7 | | |
| SGNCK | Branch Point Used To Check Sign Flag In TEMP1 From MAD Subroutines | | 803E | | |
| SGNFG | Address Which Contains Sign Of Ramp Slope | 1 | | | $2E |
| SHFT | Branch Point To Shift Control Register One Place BCD | | 80C4 | | |
| SK2 | Branch Point To Test For EVEN/ODD Conditions | | 7C91 | | |
| SK3 | Branch Point For EVEN Condition | | 7C99 | | |
| SK4 | Branch Point For Positive Speed Error | | 7F15 | | |
| SK5 | Branch Point To Energize DCS Relay | | 7EF6 | | |
| SKIP | Branch Point If Both INC & DECR PB's Are On | | 7E60 | | |

-continued

APPENDIX A
SYMBOL AND LABEL DICTIONARY

| NAME | DESCRIPTION | BYTES | BRANCH POINT | VALUE | PAGE ADDR |
|---|---|---|---|---|---|
| SMON | Mask To Test Speed Error Light | 1 | | $10 | |
| SMSRB | Mask To Control The Initial Latch Clock Setting For SPM And SPR Displays BCD Subroutine Changes This Logical Setting In Accumulator | | | $E8 | |
| SNCHG | Branch Point To Test Change In Sign Of Ramp Slope | | 7DD7 | | |
| SPCON | Branch Point To Initiate Speed Control ODD Branch | | 7EEC | | |
| SPD | Address Of Speed Demand | 2 | | | $05 |
| SPDER | Address Of Absolute Value Of Speed Error | 2 | | | $0F |
| SPDGZ | Branch Point If SPD Is Greater Than Zero | | 7E0C | | |
| SPDHG | Value Of Upper Limit Of Speed Demand | | | 3600 | |
| SPDLW | Value Of Lower Limit Of Speed Demand | | | 0 | |
| SPDN | Branch Point Used To Set 32 In COUNT In MAD Subroutines | | 7FD8 | | |
| SPDOF | Branch Point If Speed Dem Lamp off | | 7E83 | | |
| SPM | Address Of Speed Measurement | 3 | | | 0 |
| SPMD | | 2 | | | 3 |
| SPMLP | Branch Point To Loop In Speed Measurement Calc | | 7CA4 | | |
| SPR | Address Of Speed Reference | 2 | | | 7 |
| SPRO | Address Of Old Speed Reference | 2 | | | $11 |
| SPRSD | Branch Point To Test SPR = SPD | | 7DB0 | | |
| START | Branch Point To Test SPR > 3400 RPM | | 7D7C | | |
| SUBD | Branch Point To Subtract In MAD Subroutines | | 7FF8 | | |
| SVSG | Branch Point To Save Sign And Carry Bits In MAD Subr | | 8008 | | |
| TEMPO | Address Of Temporary Memory Location | 1 | | | $25 |
| TEMP1 | Address Of Temporary Memory Location | 1 | | | $26 |
| TEMP2 | Address Of Temporary Memory Location | 1 | | | $27 |
| TEMP3 | Address Of Temporary Memory Location | 2 | | | $28 |
| TIME | Branch Point To Increment HN Counter | | 7D46 | | |
| TMCNT | Address Of Time Counter | 1 | | | $2F |
| WAIT | Branch Point To Service Interrupt | | 7C45 | | |
| WILD | Branch Point To Half Processing | | 7C6D | | |
| WILD1 | Branch Point To Halt Processing | | 7C6E | | |
| ZCLR | Branch Point To Clear Page Zero | | 7C06 | | |

APPENDIX B

ASSEMBLED LISTING OF PROM SOURCE

```
00090                    OPT    S
00100                    NAM    SPERC1
00110    03E8    ACLHG   EQU    1000
00120    0000    ACLLW   EQU    0
00130    00B0    ACSPB   EQU    ~~$B0~~ $B8
00140    0004    BASL    EQU    4
00150    0008    BDCS    EQU    8
00160    00F3    BIDLF   EQU    $F3
00170    0004    BILTN   EQU    $4
00180    0010    BLSPD   EQU    $10
00190    0010    BSDLT   EQU    $10
00200    0080    BSRLT   EQU    $80
00210    00EF    CBMON   EQU    $EF
00220    0002    GOLTN   EQU    2
00230    00FD    GOLTF   EQU    $FD
00240    0001    HDLTN   EQU    1
00250    00FE    HLDTF   EQU    $FE
00260    000C    IDMSK   EQU    $C
00270    0011    MONLT   EQU    $11
00280    0080    KID0    EQU    128
00290    0100    KID1    EQU    256
```

```
00300        0040    KID2    EQU     64
00310        0080    KID3    EQU     128
00320        0020    KID4    EQU     32
00330        0040    KID5    EQU     64
00340        0010    KID6    EQU     16
00350        0020    KID7    EQU     32
00360        0008    KID8    EQU     8
00370        0010    KID9    EQU     16
00380        0004    KID10   EQU     4
00390        0008    KID11   EQU     8
00400        0002    KID12   EQU     2
00410        0004    KID13   EQU     4
00420        0001    KID14   EQU     1
00430        0002    KID15   EQU     2
00440        0001    KPN0    EQU     1
00450        0001    KPN1    EQU     1
00460        0002    KPN2    EQU     2
00470        0002    KPN3    EQU     2
00480        0004    KPN4    EQU     4
00490        0004    KPN5    EQU     4
00500        0008    KPN6    EQU     8
00510        0008    KPN7    EQU     8
00520        0010    KPN8    EQU     16
00530        0010    KPN9    EQU     16
00540        0020    KPN10   EQU     32
00550        0020    KPN11   EQU     32
00560        0040    KPN12   EQU     64
00570        0040    KPN13   EQU     64
00580        0080    KPN14   EQU     128
00590        0080    KPN15   EQU     128
00600        0105    PI1CRA  EQU     $105
00610        0107    PI1CRB  EQU     $107
00620        0101    PI0CRA  EQU     $101
00630        0103    PI0CRB  EQU     $103
00640        0100    PI0PRA  EQU     $100
00650        0102    PI0PRB  EQU     $102
00660        010C    PI3PRA  EQU     $10C
00670        0104    PI1PRA  EQU     $104
00680        0106    PI1PRB  EQU     $106
00690        010A    PI2PRB  EQU     $10A
00700        0108    PI2PRA  EQU     $108
00710        0106    PI1PRB  EQU     $106
00720        0106    PI1PRB  EQU     $106
00730        010E    PI3PRB  EQU     $10E
00740        0100    PI0PRA  EQU     $100
00750        0027    RTCEN   EQU     $27
00760        0010    SMON    EQU     $10
00770        00E0    SMSRB   EQU     ~~$E0~~ $E8
00780        0E10    SPDHG   EQU     3600
00790        0000    SPDLW   EQU     0


00810 0000                   ORG     0
00820 0000 0000      SPM     FDB     0
00830 0002 00                FCB     0
00840 0003 0000      SPMD    FDB     0
00850 0005 0000      SPD     FDB     0
00860 0007 0000      SPR     FDB     0
00870 0009 0000      ACCEL   FDB     0
00880 000B 0000      INCVL   FDB     0
00890 000D 0000      HN      FDB     0
00900 000F 0000      SPDER   FDB     0
00910 0011 0000      SPRO    FDB     0
00920 0013 0000      OUTER   FDB     0
00930 0015 0000      INTER   FDB     0
00940 0017 0000              FDB     0
00950 0019 00        BCDH    FCB     0
00960 001A 00        BCDL    FCB     0
00970 001B 0000      SCPDN   FDB     0
00980 001D 0000      SCPDD   FDB     0
00990 001F 0000      SCPDR   FDB     0
01000 0021 0000              FDB     0
01010 0023 0000      SCPDX   FDB     0
```

```
01020 0025 00        TEMP0  FCB    0
01030 0026 00        TEMP1  FCB    0
01040 0027 00        TEMP2  FCB    0
01050 0028 0000      TEMP3  FDB    0
01060 002A 00        COUNT  FCB    0
01070 002B 00        DICUP  FCB    0
01080 002C 00        DISPB  FCB    0
01090 002D 00        INIT   FCB    0
01100 002E 00        SGNFG  FCB    0
01110 002F 00        TMCNT  FCB    0
01130 FE46                  ORG    $FE46
01140                ◆ CLEAR PAGE ZERO

01160 FE46 4F               CLR A
01170 FE47 8E 007F          LDS    #$7F
01180 FE4A C6 80            LDA B  #128
01190 FE4C 36        ZCLR   PSH A
01200 FE4D 5A               DEC B
01210 FE4E 26 FC            BNE    ZCLR
01220 FE50 8E 007F          LDS    #$7F

01240                ◆ SET CONTROL REGISTERS TO 4
01250 FE00                  ORG    $FE00

01270 FE00 8E 007F          LDS    #$7F
01280 FE03 CE 0100          LDX    #$100
01290 FE06 86 04            LDA A  #4
01300 FE08 8D 4D            BSR    PIAST

01320                ◆ CLEAR PIA DATA REGISTERS

01340 FE0A 4F               CLR A
01350 FE0B 09               DEX
01360 FE0C 8D 49            BSR    PIAST

01380                ◆ CLEAR PIA CONTROL REGISTERS

01400 FE0E 8D 47            BSR    PIAST

01420                ◆ CLEAR DATA DIRECTION REGISTERS

01440 FE10 09               DEX
01450 FE11 8D 44            BSR    PIAST


01470                ◆ INITIALIZE PIA'S FROM POWER ON RESET

01490 FE13 CE 0100   INILZ  LDX    #$100
01500 FE16 6A 04            DEC    4,X       INITIALIZE DD-1
01510 FE18 6A 06            DEC    6,X
01520 FE1A 6A 08            DEC    8,X       INITIALIZE DD-2
01530 FE1C 6A 0A            DEC    $A,X
01540 FE1E 6A 0E            DEC    $E,X      INITIALIZE DD-3
01550 FE20 6A 12            DEC    $12,X     INILTIALIZE DD-4
01560 FE22 86 F0            LDA A  #$F0      INITIALIZE DD-5
01570 FE24 A7 16            STA A  $16,X
01580 FE26 86 04            LDA A  #4
01590 FE28 8D 2D            BSR    PIAST     SET CONTROL REGISTER TO 4
01600 FE2A 86 27            LDA A  #RTCEN    RTC INT. AND ENCK CONTROL
01610 FE2C A7 03            STA A  3,X
01620 FE2F 86 FF            LDA A  #$FF
01630 FE31 A7 01            STA A  1,X       OVERFLOW INT. AND CLR. CONT
01640 FE32 86 50            LDA A  #$50
01650 FE34 B7 0106          STA A  $106
01660 FE37 FF FFFF          STX    $FFFF
01670 FE3A FF FFFF          STX    $FFFF
01680 FE3D FF FFFF          STX    $FFFF
01690 FE40 FF FFFF          STX    $FFFF
01700 FE43 FF FFFF          STX    $FFFF

01720 FE53                  ORG    $FE53
01730 FE53 0E               CLI
01740 FE54 3E        WAIT   WAI
01750 FE55 20 FD            BRA    WAIT
```

```
01770 FE57 C6 0C    PIACT  LDA B  #$C
01780 FE59 A7 01    INLP1  STA A  1,X       SET ALL PIA REGISTERS TO CO
01790 FE5B 08              INX
01800 FE5C 08              INX
01810 FE5D 5A              DEC B
01820 FE5E 26 F9           BNE    INLP1
01830 FE60 CE 0100         LDX    #$100
01840 FE63 39              RTS                RETURN
01860 F600                 ORG    $F600
01870 F600 B6 0101 INT     LDA A  PIOCRA     TEST SOURCE OF INTERRUPT
01880 F603 2A 16           BPL    RTCIN
01890 F605 88 12           EOR A  #$12       TOGGLE INT. CONTROL BIT
01900 F607 B7 0101         STA A  PIOCRA
01910 F60A F6 0100         LDA B  PIOPRA
01920 F60D 88 10           EOR A  #$10       ENABLE AUTO RESET FUNCTION
01930 F60F B7 0101         STA A  PIOCRA
01940 F612 7C 0028         INC    TEMP3
01950 F615 2B 01           BMI    WILD
01960 F617 3B              RTI                RETURN FROM INTERRUPT
01970 F618 3E      WILD    WAI                FAILURE DETECT EXIT, HALT A
01980 F619 32      WILD1   PUL A              FIX STACK
01990 F61A 3E              WAI                HALT

02010              * REAL TIME CLOCK INTERRUPT

02030 F61B F6 0102 RTCIN   LDA B  PIOPRB     LOAD COUNT, CLEAR INTERRUPT
02040 F61E 86 2F           LDA A  #$2F       RESET OVERFLOW
02050 F620 B7 0101         STA A  PIOCRA
02060 F623 B6 0100         LDA A  PIOPRA     SCAN SWITCHES, CLR. COUNTER
02070 F626 B7 0102         STA A  PIOPRB     ENABLE COUNTER
02080 F629 36              PSH A             SAVE SWITCH SCAN
02090 F62A 4F              CLR A             ACCUMULATE SPEED READING IN
02100 F62B DB 29           ADD B  TEMP3+1
02110 F62D D7 29           STA B  TEMP3+1
02120 F62F 99 28           ADC A  TEMP3
02130 F631 97 28           STA A  TEMP3
02140 F633 7A 002B         DEC    DISUP      DECREMENT TIMER
02150 F636 2A 04           BPL    SK2
02160 F638 86 1F           LDA A  #31
02170 F63A 97 2B           STA A  DISUP
02180 F63C 96 2B   SK2     LDA A  DISUP      TEST ODD/EVEN
02190 F63E 46              ROR A
02200 F63F 24 03           BCC    SK3        EVEN SCHEDULE
02210 F641 7E F701         JMP    SPCON      ODD SCHEDULE
02220 F644 96 02   SK3     LDA A  SPM+2      SAVE SPM
02230 F646 97 26           STA A  TEMP1
02240 F648 D6 01           LDA B  SPM+1
02250 F64A 96 00           LDA A  SPM
02260 F64C 36              PSH A

02280              * .5 SEC. FILTER ON SPM

02290 F64D 86 04           LDA A  #4         CALC. SPM/16
02310 F64F 77 0000 SPMLP   ASR    SPM
02320 F652 76 0001         ROR    SPM+1
02330 F655 76 0002         ROR    SPM+2
02340 F658 4A              DEC A
02350 F659 26 F4           BNE    SPMLP
02360 F65B 96 26           LDA A  TEMP1
02370 F65D 90 02           SUB A  SPM+2      CALC. SPM-SPM/16
02380 F65F 97 02           STA A  SPM+2
02390 F661 32              PUL A             RECOVER SPM
02400 F662 D2 01           SBC B  SPM+1
02410 F664 92 00           SBC A  SPM
02420 F666 78 0029         ASL    TEMP3+1     ADJUST TEMP3 FOR 1/4 RPM R
02430 F669 79 0028         ROL    TEMP3
02440 F66C 2B AB           BMI    WILD1
02450 F66E 78 0029         ASL    TEMP3+1
02460 F671 79 0028         ROL    TEMP3
02470 F674 2B A3           BMI    WILD1
02480 F676 DB 29           ADD B  TEMP3+1     ADD NEW SPEED READINGS
02490 F678 99 28           ADC A  TEMP3
02500 F67A 29 9D           BVS    WILD1
02510 F67C D7 01           STA B  SPM+1
```

```
02520 F67E 97 00          STA A  SPM
02530 F680 4F             CLR A
02540 F681 97 29          STA A  TEMP3+1    CLR. SPEED READING
02550 F683 97 28          STA A  TEMP3


02570              * DISPLAY UPDATE

02590 F685 32             PUL A            RECOVER PANEL SCAN
02600 F686 16             TAB              SAVE PANEL SCAN
02610 F687 43             COM A            DEBOUNCE PUSHBUTTON
02620 F688 94 2C          AND A  DISPB
02630 F68A D7 2C          STA B  DISPB     SAVE CURRENT SCAN
02640 F68C 5F             CLR B            TOGGLE DISPLAY INDICATORS
02650 F68D 46             ROR A            SET UP TOGGLE MASK
02660 F68E 56             ROR B
02670 F68F 57             ASR B
02680 F690 46             ROR A
02690 F691 56             ROR B
02700 F692 57             ASR B
02710 F693 F8 0106        EOR B  PI1PRB
02720 F696 F7 0106        STA B  PI1PRB
02730 F699 37             PSH B            SAVE B

02750              * TEST FOR BOTH LIGHTS ON OR OFF

02770 F69A C4 F0          AND B  #$F0
02780 F69C 27 0F          BEQ    LTERR
02790 F69E C1 F0          CMP B  #$F0
02800 F6A0 27 0B          BEQ    LTERR
02810 F6A2 58      PARCK  ASL B            CHECK PARITY OF REMAINING B
02820 F6A3 27 06          BEQ    ODDCK
02830 F6A5 24 FB          BCC    PARCK
02840 F6A7 CB 80          ADD B  #$80
02850 F6A9 20 F7          BRA    PARCK
02860 F6AB 24 0C   ODDCK  BCC    EVEN     PARITY IS EVEN
02870 F6AD C6 0F   LTERR  LDA B  #$F
02880 F6AF F4 0106        AND B  PI1PRB
02890 F6B2 CA 50          ORA B  #$50
02900 F6B4 32             PUL A            SAVE NEW B
02910 F6B5 37             PSH B
02920 F6B6 F7 0106        STA B  PI1PRB

02940 F6B9 33      EVEN   PUL B            RECOVER B
02950 F6BA 37             PSH B            RE-SAVE B
02960 F6BB 86 ~~BF~~ B8   LDA A  #ACSPR    SET UP DISPLAY LATCH CONTR
02970 F6BD 97 27          STA A  TEMP2
02980 F6BF CE 0005        LDX    #SPD
02990 F6C2 C5 10          BIT B  #BSDLT    DETERMINE WHICH DISPLAY
03000 F6C4 26 03          BNE    D1        SPD DISPLAY
03010 F6C6 CE 0009        LDX    #ACCEL
03020 F6C9 BD FF3A D1     JSR    BCD
03030 F6CC 33             PUL B
03040 F6CD 86 ~~E7~~ E8   LDA A  #SMSPR    REPEAT FOR SPM/SPR
03050 F6CF 97 27          STA A  TEMP2
03060 F6D1 CE 0007        LDX    #SPR
03070 F6D4 C5 80          BIT B  #BSRLT
03080 F6D6 26 16          BNE    D2        SPR DISPLAY
03090 F6D8 CE 0003        LDX    #SPMD     SPM DISPLAY
03100 F6DB 96 00          LDA A  SPM       AVERAGE SPM AND SPMD TO SMO
03110 F6DD D6 01          LDA B  SPM+1
03120 F6DF EB 01          ADD B  1,X
03130 F6E1 A9 00          ADC A  0,X
03140 F6E3 46             ROR A
03150 F6E4 56             ROR B
03160 F6E5 97 03          STA A  SPMD
03170 F6E7 D7 04          STA B  SPMD+1
03180 F6E9 7D 002B        TST    DISUP     UPDATE EVERY 1/2 SECONDS
03190 F6EC 26 03          BNE    TIME
03200 F6EE BD FF3A D2     JSR    BCD
03210 F6F1 DE 0D   TIME   LDX    HN        INCREMENT TIME
03220 F6F3 08             INX
03230 F6F4 DF 0D          STX    HN
03240 F6F6 8C 8000        CPX    #$8000
```

```
****ERROR 203  BEGIN
03250 F6F9 26 FB 03          BNE     BEGINX
03260 F6FB BD FAA8           JSR     RMPCT
      F6FE 7E FA00 BEGINX    JMP     BEGIN
03280 FA00                   ORG     $FA00
03290 FA00 D6 2C    BEGIN    LDA B   DICPB
03300 FA02 C5 04             BIT B   #BACL
03310 FA04 26 08             BNE     GO          WAIT FOR CONTACT CLOSURE
03320 FA06 86 01    NORLY    LDA A   #HDLTN      RESET GO LIGHT, SET HOLD L
03330 FA08 C6 FD             LDA B   #GOLTF
03340 FA0A BD FB88           JSR     LIGHT
03350 FA0D 3B                RTI
03360 FA0E 86 34    GO       LDA A   #$34        ENERGIZE DCS
03370 FA10 B7 0105           STA A   PI1CRA
03380 FA13 86 3C             LDA A   #$3C
03390 FA15 B7 0105           STA A   PI1CRA
03400 FA18 C5 08             BIT B   #BDCS       WAIT FOR CONTACT CLOSURE
03410 FA1A 27 EA             BEQ     NORLY
03420 FA1C 7D 002D           TST     INIT        CHECK INITIALIZE FLAG
03430 FA1F 26 08             BNE     START
03440 FA21 96 00             LDA A   SPM         SET SPR TO SPM
03450 FA23 D6 01             LDA B   SPM+1
03460 FA25 97 07             STA A   SPR
03470 FA27 D7 08             STA B   SPR+1
03480 FA29 B6 FB93  START    LDA A   C3400       COMPARE SPR TO 3400
03490 FA2C F6 FB94           LDA B   C3400+1
03500 FA2F D0 08             SUB B   SPR+1
03510 FA31 92 07             SBC A   SPR
03520 FA33 2B 28             BMI     SPRSD       SPR > 3400
03530 FA35 D6 10             LDA B   SPDER+1
03540 FA37 96 0F             LDA A   SPDER       GET ABS(SPDER)
03550 FA39 F0 FB96           SUB B   C300+1      COMPARE TO 300
03560 FA3C B2 FB95           SBC A   C300
03570 FA3F 2A 0F             BPL     ERROR       ERROR > 300
03580 FA41 F6 010E           LDA B   PI3PRB      TEST SPEED MON. LIGHT
03590 FA44 C5 10             BIT B   #SMON
03600 FA46 27 15             BEQ     SPRSD       LIGHT IS OFF
03610 FA48 C4 EF             AND B   #CBMON      CLEAR SPEED MON. LIGHT
03620 FA4A F7 010E           STA B   PI3PRB
03630 FA4D 7E FAE5           JMP     CONTL
03640 FA50 96 07    ERROR    LDA A   SPR         SET SPD TO SPR
03650 FA52 D6 08             LDA B   SPR+1
03660 FA54 97 05             STA A   SPD
03670 FA56 D7 06             STA B   SPD+1
03680 FA58 86 11             LDA A   #MONLT      SET MON.+HOLD LT.-CLR GO L
03690 FA5A 7E FAE0           JMP     EQUAL
03700 FA5D 96 07    SPRSD    LDA A   SPR         COMPARE SPR AND SPD
03710 FA5F 90 05             SUB A   SPD
03720 FA61 26 06             BNE     NOTEQ
03730 FA63 96 08             LDA A   SPR+1
03740 FA65 90 06             SUB A   SPD+1
03750 FA67 27 77             BEQ     EQUAL
03760 FA69 B6 010C  NOTEQ    LDA A   PI3PRA      TEST PB.
03770 FA6C F6 010E           LDA B   PI3PRB      TEST LIGHTS
03780 FA6F 56                ROR B               TEST HOLD LIGHT
03790 FA70 25 64             BCS     HLTON       HOLD LT. ON
03800 FA72 46                ROR A               TEST HOLD PB.
03810 FA73 25 69             BCS     HPBON       HOLD PB. ON
03820 FA75 56                ROR B               TEST GO LIGHT
03830 FA76 24 3E             BCC     GLTOF       GO LIGHT OFF

03850 FA78 96 05    RAMP     LDA A   SPD         COMPARE SPD TO SPR
03860 FA7A D6 06             LDA B   SPD+1
03870 FA7C D0 08             SUB B   SPR+1
03880 FA7E 92 07             SBC A   SPR
03890 FA80 2A 23             BPL     ADRMP       SPD > SPR
03900 FA82 C6 80             LDA B   #$80        SET NEW SIGN FLAG NEGATIVE
03910 FA84 96 2E    SNCHG    LDA A   SGNFG       GET OLD SIGN FLAG
03920 FA86 D7 2E             STA B   SGNFG
03930 FA88 D7 26             STA B   TEMP1       STORE FLAG FOR "MAD"
03940 FA8A 98 2E             EOR A   SGNFG       CHECK FOR SIGN CHANGE
03950 FA8C 27 02             BEQ     INCRM       NO CHANGE
```

```
03960 FA8E 8D 18          BSR    RMPST
03970 FA90 CE 000D INCRM  LDX    #HN        COMPUTE INCREMENTAL RAMP C
03980 FA93 BD FE76        JSR    MAD1
03990 FA96 FB97           FDB    C3840
04000 FA98 0009           FDB    ACCEL
04010 FA9A DB 12          ADD B  SPRO+1     COMPUTE NEW SPR
04020 FA9C 99 11          ADC A  SPRO
04030 FA9E D7 08          STA B  SPR+1
04040 FAA0 97 07          STA A  SPR
04050 FAA2 7E FAF7        JMP    PBOFF
04060 FAA5 5F       ADRMP CLR B              SET NEW SIGN FLAG TO 0
04070 FAA6 20 DC          BRA    SNCHG


04090 FAA8 96 07    RMPST LDA A  SPR         RESET START OF RAMP
04100 FAAA D6 08          LDA B  SPR+1
04110 FAAC 97 11          STA A  SPRO
04120 FAAE D7 12          STA B  SPRO+1
04130 FAB0 4F             CLR A
04140 FAB1 97 0D          STA A  HN
04150 FAB3 97 0E          STA A  HN+1
04160 FAB5 39             RTS


04180 FAB6 46       GLTOF ROR A              TEST GO PB.
04190 FAB7 24 2C          BCC    CONTL       GO BUTTON OFF
04200 FAB9 7D 002D SPDGZ  TST    INIT        IF FLAG CLEAR, SKIP SPD TES
04210 FABC 26 05          BNE    OV2
04220 FABE 7D 0005        TST    SPD         GO PB. IS ON, SPD>0 ?
04230 FAC1 27 0C          BEQ    OV1
04240 FAC3 C6 FE    OV2   LDA B  #HLDTF      SET GO LIGHT, CLEAR HOLD L
04250 FAC5 86 02          LDA A  #GOLTN
04260 FAC7 BD FB88        JSR    LIGHT
04270 FACA 7A 002D        DEC    INIT        CLEAR INITIALIZE FLAG
04280 FACD 20 A9          BRA    RAMP
04290 FACF 7D 0006 OV1    TST    SPD+1
04300 FAD2 26 EF          BNE    OV2
04310 FAD4 20 0F          BRA    CONTL
04320 FAD6 46       HLTON ROR A              TEST HOLD PB.
04330 FAD7 25 05          BCS    HPBON       HOLD BUTTON ON
04340 FAD9 46             ROR A              TEST GO PB.
04350 FADA 24 09          BCC    CONTL       GO BUTTON OFF
04360 FADC 20 DB          BRA    SPDGZ       GO BUTTON ON
04370 FADE 86 01    HPBON LDA A  #HDLTN      RESET GO LIGHT, SET HOLD L
04380 FAE0 C6 FD    EQUAL LDA B  #GOLTF
04390 FAE2 BD FB88        JSR    LIGHT
04400 FAE5 8D C1    CONTL BSR    RMPST       RESET RAMP

04420                 * INC/DEC ROUTINE

04440 FAE7 7D 000E INCDC  TST    HN+1        TEST INC/DEC PB. ONLY IF ..
04450 FAEA 26 0B          BNE    PBOFF       ........ NOT RAMPING
04460 FAEC 86 0C          LDA A  #IDMSK      TEST INC/DEC PB.
04470 FAEE B4 010C        AND A  PIBPRA
04480 FAF1 27 04          BEQ    PBOFF       INC/DEC OFF
04490 FAF3 81 0C          CMP A  #$C
04500 FAF5 26 0F          BNE    PBON        INC/DEC ON
04510 FAF7 4F       PBOFF CLR A
04520 FAF8 97 0B          STA A  INCVL       CLEAR INCREMENTAL CHANGE
04530 FAFA 97 0C          STA A  INCVL+1
04540 FAFC C6 10          LDA B  #16         SET TIME COUNTER TO 16
04550 FAFE D7 2F          STA B  TMCNT
04560 FB00 C6 F3          LDA B  #$F3        TURN OFF INC/DEC LIGHTS
04570 FB02 BD FB88        JSR    LIGHT
04580 FB05 3B             RTI                RETURN
04590 FB06 C6 F7    PBON  LDA B  #$F7
04600 FB08 81 04          CMP A  #4          TEST INC/DEC PB
04610 FB0A 27 01          BEQ    SKIP
04620 FB0C 57             ASR B
04630 FB0D 8D 79    SKIP  BSR    LIGHT       SET/RESET INC/DEC LIGHT
04640 FB0F 7A 002F        DEC    TMCNT       TEST TMCNT
04650 FB12 27 01          BEQ    DELTA       CHANGE VALUE IN MEMORY
```

```
04660 FB14 3B                RTI                 RETURN
04670 FB15 DE 0B    DELTA    LDX     INCVL       INCREASE INCREMENTAL VALUE
04680 FB17 08                INX
04690 FB18 08                INX
04700 FB19 08                INX
04710 FB1A 08                INX
04720 FB1B DF 0B             STX     INCVL
04730 FB1D C6 10             LDA B   #16         RESET TIME COUNTER
04740 FB1F D7 2F             STA B   TMCNT
04750 FB21 F6 0106           LDA B   PI1PRB      TEST SPD LIGHT
04760 FB24 C5 10             BIT B   #BLSPD
04770 FB26 27 08             BEQ     SPDOF       SPD LIGHT OFF
04780 FB28 8D 0E             BSR     LIMIT       MODIFY DATA
04790 FB2A 0005            → FDB     SPD
04800 FB2C 3840              FDB     SPDHG*4
04810 FB2E 0000              FDB     SPDLW*4
04820 FB30 8D 06    SPDOF    BSR     LIMIT
04830 FB32 0009              FDB     ACCEL
04840 FB34 0FA0              FDB     ACLHG*4
04850 FB36 0000              FDB     ACLLW*4

04870                 * LIMIT ROUTINE

04890 FB38 30       LIMIT    TSX                 LOAD DATA
04900 FB39 EE 00             LDX     0,X
04910 FB3B EE 00             LDX     0,X
04920 FB3D E6 01             LDA B   1,X
04930 FB3F 85 04             BIT A   #BILTN      TEST INCREASE LIGHT
04940 FB41 27 24             BEQ     DECR        DECREASE DATA
04950 FB43 A6 00             LDA A   0,X
04960 FB45 DB 0C             ADD B   INCVL+1      INCREASE DATA
04970 FB47 99 0B             ADC A   INCVL
04980 FB49 30                TSX
04990 FB4A EE 00             LDX     0,X
05000 FB4C 36                PSH A               SAVE A
05010 FB4D E1 03             CMP B   3,X         CHECK UPPER LIMIT
05020 FB4F A2 02             SBC A   2,X
05030 FB51 2B 28             BMI     RANGE       IN RANGE
05040 FB53 86 01    OUTRG    LDA A   #1          SET TMCNT TO 1
05050 FB55 97 2F             STA A   TMCNT
05060 FB57 4F                CLR A               DATA OUT OF RANGE
05070 FB58 97 0B             STA A   INCVL       CLEAR INCVL AND INC/DEC LTS
05080 FB5A 97 0C             STA A   INCVL+1
05090 FB5C C6 F3             LDA B   #BIDLF
05100 FB5E 8D 28             BSR     LIGHT
05110 FB60 A6 02             LDA A   2,X         SET LIMIT
05120 FB62 E6 03             LDA B   3,X
05130 FB64 31                INS                 FIX STACK
05140 FB65 20 15             BRA     EXIT
05150 FB67 A6 00    DECR     LDA A   0,X
05160 FB69 D0 0C             SUB B   INCVL+1      DECREASE DATA
05170 FB6B 92 0B             SBC A   INCVL
05180 FB6D 30                TSX
05190 FB6E EE 00             LDX     0,X
05200 FB70 36                PSH A               SAVE A
05210 FB71 E1 05             CMP B   5,X         CHECK LOWER LIMIT
05220 FB73 A2 04             SBC A   4,X
05230 FB75 2A 04             BPL     RANGE
05240 FB77 08                INX
05250 FB78 08                INX
05260 FB79 20 D8             BRA     OUTRG
05270 FB7B 32       RANGE    PUL A               RECOVER A
05280 FB7C 30       EXIT     TSX
05290 FB7D EE 00             LDX     0,X         GET ADDRESS OF DATA
05300 FB7F EE 00             LDX     0,X
05310 FB81 E7 01             STA B   1,X         STORE DATA
05320 FB83 A7 00             STA A   0,X
05330 FB85 31                INS                 FIX STACK
05340 FB86 31                INS
05350 FB87 3B                RTI                 RETURN
```

```
05370 FB88 BA 010E LIGHT  ORA A  PI3PRB   TURN LIGHTS ON
05380 FB8B 97 27          STA A  TEMP2
05390 FB8D D4 27          AND B  TEMP2    TURN LIGHTS OFF
05400 FB8F F7 010E        STA B  PI3PRB
05410 FB92 39             RTS              RETURN


05430 FB93 3520    C3400  FDB    3400*4
05440 FB95 04B0    C300   FDB    300*4
05450 FB97 0780    C3840  FDB    3840/2

05470 F701                ORG    $F701
05480 F701 32      SPCON  PUL A            FIX STACK
05490 F702 D6 2C          LDA B  DISPB     CHECK ASL CONTACT
05500 F704 C5 04          BIT B  #BASL     WAIT FOR CONTACT CLOSURE
05510 F706 26 03          BNE    SK5
05520 F708 7E FAD6 NRLY   JMP    NORLY
05530 F70B 86 34   SK5    LDA A  #$34      ENERGIZE DCS
05540 F70D B7 0107        STA A  PI1CRB
05550 F710 86 3C          LDA A  #$3C
05560 F712 B7 0107        STA A  PI1CRB
05570 F715 C5 08          BIT B  #BDCS     WAIT FOR CONTACT CLOSURE
05580 F717 27 EF          BEQ    NRLY

05600 F719 96 07          LDA A  SPP       CALC. SPEED ERROR
05610 F71B D6 08          LDA B  SPP+1
05620 F71D D0 01          SUB B  SPM+1
05630 F71F 92 00          SBC A  SPM
05640 F721 97 26          STA A  TEMP1     STORE SIGN OF ERROR FOR MAD
05650 F723 2A 05          BPL    SK4       SAVE ABS (ERROR)
05660 F725 43             COM A            NEGATE ERROR
05670 F726 50             NEG B
05680 F727 25 01          BCS    SK4
05690 F729 4C             INC A
05700 F72A 97 0F   SK4    STA A  SPDER
05710 F72C D7 10          STA B  SPDER+1

05730              * CALCULATE ADDRESS OF PROPORTIONAL + INTEGRAL CON

05750 F72E 96 2C          LDA A  DISPB     GET BINARY SWITCH INPUT
05760 F730 84 F0          AND A  #$F0
05770 F732 0C             CLC              SHIFT TO PROPER POSITION
05780 F733 46             ROR A
05790 F734 46             ROR A
05800 F735 BB F7FF        ADD A  BASE+1    ADD INDEX TO BASE
05810 F738 97 24          STA A  SCPDX+1    SAVE LSB OF ADDRESS
05820 F73A B6 F7FE        LDA A  BASE      CALC. MSB OF ADDRESS
05830 F73D 89 00          ADC A  #0
05840 F73F 97 23          STA A  SCPDX
05850 F741 DE 23          LDX    SCPDX     LOAD ADRESS INTO INDEX REGI
05860 F743 BD FE76        JSR    MAD1      CALC. KP*ERROR
05870 F746 F7BA           FDB    KPD
05880 F748 000F           FDB    SPDER
05890 F74A 97 13          STA A  OUTER
05900 F74C D7 14          STA B  OUTER+1    SAVE RESULT
05910 F74E 08             INX              ADRESS SECOND ENTRY OF PAIR
05920 F74F 08             INX
05930 F750 BD FE64        JSR    MAD2      CALC. KI*ERROR
05940 F753 F7BC           FDB    KIN
05950 F755 000F           FDB    SPDER
05960 F757 96 17          LDA A  INTER+2    ACCUMULATE SUM OF ERRORS
05970 F759 D6 18          LDA B  INTER+3
05980 F75B DB 22          ADD B  SCPDR+3
05990 F75D 99 21          ADC A  SCPDR+2
06000 F75F D7 18          STA B  INTER+3
06010 F761 97 17          STA A  INTER+2
06020 F763 D6 20          LDA B  SCPDR+1
06030 F765 96 1F          LDA A  SCPDR
06040 F767 CE 0015        LDX    #INTER
06050 F76A 8D 32          BSR    DADD
06060 F76C 96 15          LDA A  INTER     CLAMP SUM AT ZERO IF NEGATI
06070 F76E 2A 0A          BPL    CON1      NOT NEGATIVE
```

```
06080 F770 4F                CLR A
06090 F771 97 18             STA A   INTER+3
06100 F773 97 17             STA A   INTER+2
06110 F775 97 16             STA A   INTER+1
06120 F777 97 15             STA A   INTER
06130 F779 5F                CLR B
06140 F77A CE 0013 CON1      LDX     #OUTER
06150 F77D 0C                CLC                     CLEAR CARRY
06160 F77E 8D 1E             BSR     DADD            CALC KP*E+KI*SUM(E)


06180 F780 2A 02             BPL     NOTNE           OUTPUT TO D/A
06190 F782 4F                CLR A
06200 F783 5F                CLR B
06210 F784 59        NOTNE   ROL B
06220 F785 49                ROL A
06230 F786 56                ROR B
06240 F787 56                ROR B
06250 F788 56                ROR B
06260 F789 56                ROR B
06270 F78A D7 26     DAOUT   STA B   TEMP1           LSB OF D/A
06280 F78C C4 0F             AND B   #$F
06290 F78E D7 27             STA B   TEMP2
06300 F790 F6 0106           LDA B   PI1PRB
06310 F793 C4 F0             AND B   #$F0
06320 F795 DA 27             ORA B   TEMP2
06330 F797 F7 0106           STA B   PI1PRB
06340 F79A B7 0104           STA A   PI1PRA
06350 F79D 3B                RTI                     RETURN


06370 F79E E9 01     DADD    ADC B   1,X             ADD DATA
06380 F7A0 A9 00             ADC A   0,X
06390 F7A2 28 0B             BVC     DEXIT           EXIT IF NO OVERFLOW
06400 F7A4 2A 06             BPL     NEGOV           TEST SIGN OF OVERFLOW
06410 F7A6 86 7F             LDA A   #$7F            POSITIVE OVERFLOW
06420 F7A8 C6 FF             LDA B   #$FF
06430 F7AA 20 03             BRA     DEXIT
06440 F7AC 86 80     NEGOV   LDA A   #$80            NEG. OVERFLOW
06450 F7AE 5F                CLR B
06460 F7AF E7 01     DEXIT   STA B   1,X
06470 F7B1 A7 00             STA A   0,X
06480 F7B3 39                RTS
06500 FE64                   ORG     $FE64
06510                * MULTIPLY AND DIVIDE SUBROUTINE
06520 FE64 0D        MAD2    SEC                     ADDRESS OF DENOMINATOR IN I
06530 FE65 DF 23             STX     SCPDX           SAVE INDEX REGISTER
06540 FE67 A6 00             LDA A   0,X             LOAD DENOMINATOR
06550 FE69 97 1D             STA A   SCPDD
06560 FE6B A6 01             LDA A   1,X
06570 FE6D 97 1E             STA A   SCPDD+1
06580 FE6F 30                TSX                     LOAD ADDRESS OF NUMERATOR
06590 FE70 EE 00             LDX     0,X
06600 FE72 EE 00             LDX     0,X
06610 FE74 20 03             BRA     MAD1A
06620 FE76 0C        MAD1    CLC                     ADDRESS OF NUMERATOR IN IND
06630 FE77 DF 23             STX     ICPDX           SAVE INDEX REGISTER
06640 FE79 A6 00     MAD1A   LDA A   0,X             LOAD NUMERATOR
06650 FE7B 97 1B             STA A   ICPDN
06660 FE7D A6 01             LDA A   1,X
06670 FE7F 97 1C             STA A   ICPDN+1
06680 FE81 25 0D             BCS     MADM            GET ADDRESS OF MULTIPLIER
06690 FE83 30                TSX                     LOAD ADDRESS OF DENOMINATOR
06700 FE84 EE 00             LDX     0,X
06710 FE86 EE 00             LDX     0,X
06720 FE88 A6 00             LDA A   0,X             LOAD DENOMINATOR
06730 FE8A 97 1D             STA A   ICPDD
06740 FE8C A6 01             LDA A   1,X
06750 FE8E 97 1E             STA A   ICPDD+1
06760 FE90 30        MADM    TSX                     GET ADDRESS OF MULTIPLIER
06770 FE91 EE 00             LDX     0,X
06780 FE93 EE 02             LDX     2,X
```

```
06790 FE95 32              PUL A          FIX RETURN ADDRESS
06800 FE96 33              PUL B
06810 FE97 CB 04           ADD B  #4
06820 FE99 89 00           ADC A  #0
06830 FE9B 37              PSH B
06840 FE9C 36              PSH A
06850 FE9D 86 20    SPDN   LDA A  #32     SET COUNTER TO 32
06860 FE9F 97 2A           STA A  COUNT
06870 FEA1 4F              CLR A
06880 FEA2 5F              CLR B
06890 FEA3 97 21           STA A  SCPDR+2  CLEAR RESULT
06900 FEA5 D7 22           STA B  SCPDR+3
06910 FEA7 97 20           STA A  SCPDR+1
06920 FEA9 D7 1F           STA B  SCPDR
06930 FEAB 97 25           STA A  TEMP0   CLEAR SIGN FLAG

06950 FEAD 78 001C MDLOP   ASL    SCPDN+1  SHIFT NUMERATOR
06960 FEB0 79 001B         ROL    SCPDN
06970 FEB3 59              ROL B
06980 FEB4 49              ROL A
06990 FEB5 36              PSH A          SAVE A
07000 FEB6 96 25           LDA A  TEMP0   TEST SAVED VALUE OF SIGN
07010 FEB8 85 08           BIT A  #8
07020 FEBA 32              PUL A          RECOVER A
07030 FEBB 26 0C           BNE    ADDD
07040 FEBD D0 1E    SUBD   SUB B  SCPDD+1  SUBTRACT DENOMINATOR
07050 FEBF 92 1D           SBC A  SCPDD
07060 FEC1 24 03           BCC    SETC    INVERT CARRY
07070 FEC3 0C              CLC
07080 FEC4 20 07           BRA    SVSG
07090 FEC6 0D       SETC   SEC
07100 FEC7 20 04           BRA    SVSG
07110 FEC9 DB 1E    ADDD   ADD B  SCPDD+1  ADD DENOMINATOR
07120 FECB 99 1D           ADC A  SCPDD
07130 FECD 36       SVSG   PSH A          SAVE SIGN AND CARRY BIT
07140 FECE 07              TPA
07150 FECF 97 25           STA A  TEMP0
07160 FED1 78 0022         ASL    SCPDR+3  SHIFT RESULT
07170 FED4 79 0021         ROL    SCPDR+2
07180 FED7 79 0020         ROL    SCPDR+1
07190 FEDA 79 001F         ROL    SCPDR
07200 FEDD 2B 4C           BMI    OVER    TEST FOR OVERFLOW
07210 FEDF 85 01           BIT A  #1      IF SAVED CARRY=1,ADD TO RE
07220 FEE1 27 1A           BEQ    NOADD   OTHERWISE SKIP ADD
07230 FEE3 37              PSH B          SAVE B
07240 FEE4 A6 00           LDA A  0,X     LOAD MULTIPLIER
07250 FEE6 E6 01           LDA B  1,X
07260 FEE8 DB 22           ADD B  SCPDR+3  ADD ACCEL. TO RESULT
07270 FEEA 99 21           ADC A  SCPDR+2
07280 FEEC 24 0A           BCC    ENDAD   PROPAGATE CARRY
07290 FEEE 7C 0020         INC    SCPDR+1
07300 FEF1 26 05           BNE    ENDAD
07310 FEF3 7C 001F         INC    SCPDR
07320 FEF6 2B 32           BMI    OVER1   TEST FOR OVERFLOW
07330 FEF8 D7 22    ENDAD  STA B  SCPDR+3  SAVE RESULT
07340 FEFA 97 21           STA A  SCPDR+2
07350 FEFC 33              PUL B          RECOVER REGISTERS
07360 FEFD 32       NOADD  PUL A
07370 FEFE 7A 002A         DEC    COUNT
07380 FF01 26 AA           BNE    MDLOP

07400 FF03 D6 26    SGNCK  LDA B  TEMP1
07410 FF05 59              ROL B          TEST SIGN FLAG
07420 FF06 24 1B           BCC    MEXIT
07430 FF08 73 001F         COM    SCPDR   NEGATE RESULT
07440 FF0B 73 0020         COM    SCPDR+1
07450 FF0E 73 0021         COM    SCPDR+2
07460 FF11 70 0022         NEG    SCPDR+3
07470 FF14 25 0D           BCS    MEXIT
```

```
07480 FF16 7C 0021          INC     SCPDR+2    PROPAGATE CARRY
07490 FF19 26 08            BNE     MEXIT
07500 FF1B 7C 0020          INC     SCPDR+1
07510 FF1E 26 03            BNE     MEXIT
07520 FF20 7C 001F          INC     SCPDR
07530 FF23 D6 20    MEXIT   LDA B   SCPDR+1
07540 FF25 96 1F            LDA A   SCPDR
07550 FF27 DE 23            LDX     SCPDX      RECOVER INDEX REGISTER
07560 FF29 39               RTS                RETURN
07570 FF2A 32       OVER1   PUL A              FIX STACK
07580 FF2B 32       OVER    PUL A              FIX STACK
07590 FF2C 86 7F            LDA A   #$7F       SET LARGEST VALUE
07600 FF2E 97 1F            STA A   SCPDR
07610 FF30 C6 FF            LDA B   #$FF
07620 FF32 D7 20            STA B   SCPDR+1
07630 FF34 D7 21            STA B   SCPDR+2
07640 FF36 D7 22            STA B   SCPDR+3
07650 FF38 20 C9            BRA     SGNCK      CHECK SIGN FLAG


07670                 * BINARY TO 4 DIGIT BCD

07690 FF3A 86 04    BCD     LDA A   #4         SET COUNTER TO 4
07700 FF3C 97 2A            STA A   COUNT
07710 FF3E 7F 001A          CLR     BCDL
07720 FF41 A6 00            LDA A   0,X        LOAD DATA
07730 FF43 2B 53            BMI     OVFL
07740 FF45 E6 01            LDA B   1,X
07750 FF47 47               ASR A              DIVIDE BY 4
07760 FF48 56               ROR B
07770 FF49 47               ASR A
07780 FF4A 56               ROR B
07790 FF4B 24 04            BCC     OVTST      ROUND OFF
07800 FF4D 5C               INC B
07810 FF4E 26 01            BNE     OVTST
07820 FF50 4C               INC A
07830 FF51 F0 FFBC  OVTST   SUB B   C104+1     CHECK FOR OVERFLOW
07840 FF54 B2 FFBB          SBC A   C104
07850 FF57 2A 3F            BPL     OVFL
07860 FF59 FB FFBC          ADD B   C104+1     RESTORE DATA
07870 FF5C B9 FFBB          ADC A   C104
07880 FF5F 20 0E            BRA     BCDLP

07900                 * MULTIPLY BY 10
07910 FF61 97 25    MPY10   STA A   TEMP0
07920 FF63 D7 26            STA B   TEMP1
07930 FF65 58               ASL B
07940 FF66 49               ROL A
07950 FF67 58               ASL B
07960 FF68 49               ROL A
07970 FF69 DB 26            ADD B   TEMP1
07980 FF6B 99 25            ADC A   TEMP0
07990 FF6D 58               ASL B
08000 FF6E 49               ROL A

08020 FF6F F0 FFBE  BCDLP   SUB B   C103+1     CALC. NEXT DIGIT
08030 FF72 B2 FFBD          SBC A   C103
08040 FF75 2B 05            BMI     DIGIT
08050 FF77 7C 001A          INC     BCDL
08060 FF7A 20 F3            BRA     BCDLP
08070 FF7C FB FFBE  DIGIT   ADD B   C103+1
08080 FF7F B9 FFBD          ADC A   C103
08090 FF82 7A 002A          DEC     COUNT      DONE?
08100 FF85 26 02            BNE     SHFT
08110 FF87 20 17            BRA     PIDPY      UPDATE DISPLAY
08120 FF89 36       SHFT    PSH A              SHIFT DIGITS ONE PLACE
08130 FF8A 86 04            LDA A   #4
08140 FF8C 78 001A  SFLP    ASL     BCDL
08150 FF8F 79 0019          ROL     BCDH
```

```
08160 FF92 4A                DEC A
08170 FF93 26 F7             BNE     IFLP
08180 FF95 32                PUL A
08190 FF96 20 C9             BRA     MPY10
08200 FF98 86 9F     OVFL    LDA A   #$9F      SET OVERFLOW DISPLAY
08210 FF9A 97 19             STA A   BCDH
08220 FF9C 86 FF             LDA A   #$FF
08230 FF9E 97 1A             STA A   BCDL


08250 FFA0 96 19     PIDPY   LDA A   BCDH      LATCH HIGH DIGITS
08260 FFA2 43                COM A
08270 FFA3 B7 0108           STA A   PI2PRA
08280 FFA6 96 27             LDA A   TEMP2
08290 FFA8 B7 010A           STA A   PI2PRB
08300 FFAB 0D                SEC
08310 FFAC 79 010A           ROL     PI2PRB    LATCH LOWER DIGITS
08320 FFAF 96 1A             LDA A   BCDL
08330 FFB1 43                COM A
08340 FFB2 B7 0108           STA A   PI2PRA
08350 FFB5 86 F0             LDA A   #$F0
08360 FFB7 B7 010A           STA A   PI2PRB
08370 FFBA 39                RTS               RETURN

08390 FFBB 2710      C104    FDB     10000
08400 FFBD 03E8      C103    FDB     1000
08420 F7BA                   ORG     $F7BA
08430 F7BA 0001      KPD     FDB     1
08440 F7BC 0001      KIN     FDB     1
08450 F7BE 0001      TABLE   FDB     KPN0
08460 F7C0 0080              FDB     KID0
08470 F7C2 0001              FDB     KPN1
08480 F7C4 0100              FDB     KID1
08490 F7C6 0002              FDB     KPN2
08500 F7C8 0040              FDB     KID2
08510 F7CA 0002              FDB     KPN3
08520 F7CC 0080              FDB     KID3
08530 F7CE 0004              FDB     KPN4
08540 F7D0 0020              FDB     KID4
08550 F7D2 0004              FDB     KPN5
08560 F7D4 0040              FDB     KID5
08570 F7D6 0008              FDB     KPN6
08580 F7D8 0010              FDB     KID6
08590 F7DA 0008              FDB     KPN7
08600 F7DC 0020              FDB     KID7
08610 F7DE 0010              FDB     KPN8
08620 F7E0 0008              FDB     KID8
08630 F7E2 0010              FDB     KPN9
08640 F7E4 0010              FDB     KID9
08650 F7E6 0020              FDB     KPN10
08660 F7E8 0004              FDB     KID10
08670 F7EA 0020              FDB     KPN11
08680 F7EC 0008              FDB     KID11
08690 F7EE 0040              FDB     KPN12
08700 F7F0 0002              FDB     KID12
08710 F7F2 0040              FDB     KPN13
08720 F7F4 0004              FDB     KID13
08730 F7F6 0080              FDB     KPN14
08740 F7F8 0001              FDB     KID14
08750 F7FA 0080              FDB     KPN15
08760 F7FC 0002              FDB     KID15
08770 F7FE F7BE      BASE    FDB     TABLE


08790 FFF8                   ORG     $FFF8
08800 FFF8 F600              FDB     $F600
08810 FFFA FFFF              FDB     $FFFF) J.M. HAS $E113
08820 FFFC FFFF              FDB     $FFFF)
08830 FFFE FE00              FDB     $FE00
08840                        END
```

SPEED CONTROLLER PROM MODIFICATIONS

| PROM | ADDRESS | WAS | IS | COMMENTS |
|---|---|---|---|---|
| 1 | F7FD | 02 | 80 | Proportional & Integral Constrants |
| 1 | F7FC | 00 | 02 | |
| 1 | F7Fb | 80 | 0E | |
| 1 | F7FA | 00 | 00 | |
| 1 | F7F9 | 01 | F7 | |
| 1 | F7F8 | 00 | 01 | |
| 1 | F7F7 | 80 | 0E | |
| 1 | F7F6 | 00 | 00 | |
| 1 | F7F5 | 04 | 9B | |
| 1 | F7F4 | 00 | 01 | |
| 1 | F7F3 | 40 | 0E | |
| 1 | F7F2 | 00 | 00 | |
| 1 | F7F1 | 02 | 40 | |
| 1 | F7F0 | 00 | 01 | |
| 1 | F7EF | 40 | 0E | |
| 1 | F7EE | 00 | 00 | |
| 1 | F7ED | 08 | E0 | |
| 1 | F7EC | 00 | 01 | |
| 1 | F7EB | 20 | 14 | |
| 1 | F7EA | 00 | 00 | |
| 1 | F7E9 | 04 | C0 | |
| 1 | F7E8 | 00 | 01 | |
| 1 | F7E7 | 20 | 14 | |
| 1 | F7E6 | 00 | 00 | |
| 1 | F7E5 | 10 | 80 | |
| 1 | F7E4 | 00 | 01 | |
| 1 | F7E3 | 10 | 14 | |
| 1 | F7E2 | 00 | 00 | |
| 1 | F7E1 | 08 | 40 | |
| 1 | F7E0 | 00 | 01 | |
| 1 | F7DF | 10 | 14 | |
| 1 | F7DE | 00 | 00 | |
| 1 | F7DD | 20 | 20 | |
| 1 | F7DC | 00 | 01 | |
| 1 | F7DB | 08 | 14 | |
| 1 | F7DA | 00 | 00 | |
| 1 | F7D9 | 10 | E0 | |
| 1 | F7D8 | 00 | 00 | |
| 1 | F7D7 | 08 | 14 | |
| 1 | F7D6 | 00 | 00 | |
| 1 | F7D5 | 40 | A0 | |
| 1 | F7D4 | 00 | 00 | |
| 1 | F7D3 | 04 | 14 | |
| 1 | F7D2 | 00 | 00 | |
| 1 | F7D1 | 20 | 66 | |
| 1 | F7D0 | 00 | 01 | |
| 1 | F7CF | 04 | 19 | |
| 1 | F7CE | 00 | 00 | |
| 1 | F7CD | 80 | 33 | |
| 1 | F7CC | 00 | 01 | |
| 1 | F7CB | 02 | 19 | |
| 1 | F7CA | 00 | 00 | |
| 1 | F7C9 | 40 | 00 | |
| 1 | F7C8 | 00 | 01 | |
| 1 | F7C7 | 02 | 19 | |
| 1 | F7C6 | 00 | 00 | |
| 1 | F7C5 | 00 | CD | |
| 1 | F7C4 | 01 | 00 | |
| 1 | F7C3 | 01 | 19 | |
| 1 | F7C2 | 00 | 00 | |
| 1 | F7C1 | 80 | 80 | |
| 1 | F7C0 | 00 | 00 | |
| 1 | F7BF | 01 | 19 | |
| 1 | F7BE | 00 | 00 | |
| 1 | F7BD | 01 | 64 | |
| 1 | F7BC | 00 | 00 | |
| 1 | F70A | 06 | 00 | Jump Addr. Change |
| 1 | F700 | 00 | B4 | |
| 1 | F6FF | FA | F7 | Jump To Patch |

SPEED CONTROLLER PROM MODIFICATIONS (continued)

| PROM | ADDRESS | WAS | IS | COMMENTS |
|---|---|---|---|---|
| 1 | F7B4 | 00 | D6 | |
| 1 | F7B5 | 00 | 2C | |
| 1 | F7B6 | 00 | 7E | Patch @ F7B4 |
| 1 | F7B7 | 00 | FA | |
| 1 | F7B8 | 00 | 0E | |
| 2 | FA00 | D6 | 7F | Set Spr. = 0 Upon $\overline{ASL}$ |
| 2 | FA01 | 2C | 00 | |
| 2 | FA02 | C% | 07 | |
| 2 | FA03 | 04 | 7F | |
| 2 | FA04 | 26 | 00 | |
| 2 | FA05 | 08 | 08 | |
| 2 | FA1B | EA | E4 | Branch Addr. Change |
| 2 | FB2C | 38 | 3B | SPD High Limit Change |
| 2 | FB2D | 40 | 60 | SPD High Limit Change |
| 2 | FB34 | 0F | 0C | Accel. High Limit Change |
| 2 | FB35 | A0 | 80 | Accel. High Limit Change |

SYMBOL TABLE

| | | | | | | | | | |
|---|---|---|---|---|---|---|---|---|---|
| ACCEL | 0009 | ACLHG | 03E8 | ACLLW | 0000 | ACSPB | 00B0 | ADDD | FEC9 |
| ADRMP | FAA5 | BASE | F7FE | BASL | 0004 | BCD | FF3A | BCDH | 0019 |
| BCDL | 001A | BCDLP | FF6F | BDCS | 0008 | BEGIN | FA00 | BIDLF | 00F3 |
| BILTN | 0004 | BLSPD | 0010 | BSDLT | 0010 | BSRLT | 0080 | C103 | FFBD |
| C104 | FFBB | C300 | FB95 | C3400 | FB93 | C3840 | FB97 | CBMON | 00EF |
| CON1 | F77A | CONTL | FAE5 | COUNT | 002A | D1 | F6C9 | D2 | F6EE |
| DADD | F79E | DAOUT | F78A | DECR | FB67 | DELTA | FB15 | DEXIT | F7AF |
| DIGIT | FF7C | DISPB | 002C | DISUP | 002B | ENDAD | FEF8 | EQUAL | FAE0 |
| ERROR | FA50 | EVEN | F6B9 | EXIT | FB7C | GLTOF | FAB6 | GO | FA0E |
| GOLTF | 00FD | GOLTN | 0002 | HDLTN | 0001 | HLDTF | 00FE | HLTON | FAD6 |
| HN | 000D | HPBON | FADE | IDMSK | 000C | INCDC | FAE7 | INCRM | FA90 |
| INCVL | 000B | INILZ | FE13 | INIT | 002D | INLP1 | FE59 | INT | F600 |
| INTER | 0015 | KID0 | 0080 | KID1 | 0100 | KID10 | 0004 | KID11 | 0008 |
| KID12 | 0002 | KID13 | 0004 | KID14 | 0001 | KID15 | 0002 | KID2 | 0040 |
| KID3 | 0080 | KID4 | 0020 | KID5 | 0040 | KID6 | 0010 | KID7 | 0020 |
| KID8 | 0008 | KID9 | 0010 | KIN | F7BC | KPD | F7BA | KPN0 | 0001 |
| KPN1 | 0001 | KPN10 | 0020 | KPN11 | 0020 | KPN12 | 0040 | KPN13 | 0040 |
| KPN14 | 0080 | KPN15 | 0080 | KPN2 | 0002 | KPN3 | 0002 | KPN4 | 0004 |
| KPN5 | 0004 | KPN6 | 0008 | KPN7 | 0008 | KPN8 | 0010 | KPN9 | 0010 |
| LIGHT | FB88 | LIMIT | FB38 | LTERR | F6AD | MAD1 | FE76 | MAD1A | FE79 |
| MAD2 | FE64 | MADM | FE90 | MDLOP | FEAD | MEXIT | FF23 | MONLT | 0011 |
| MPY10 | FF61 | NEGOV | F7AC | NOADD | FEFD | NOPLY | FA06 | NOTEQ | FA69 |
| NOTNE | F784 | NPLY | F708 | ODDCK | F6AB | OUTER | 0013 | OUTRG | FB53 |
| OV1 | FACF | OV2 | FAC3 | OVER | FF2B | OVER1 | FF2A | OVFL | FF98 |
| OVTCT | FF51 | PARCK | F6A2 | PBOFF | FAF7 | PBON | FB06 | PI0CRA | 0101 |
| PI0CRB | 0103 | PI0PRA | 0100 | PI0PRB | 0102 | PI1CRA | 0105 | PI1CRB | 0107 |
| PI1PRA | 0104 | PI1PRB | 0106 | PI2PRA | 0108 | PI2PRB | 010A | PI3PRA | 010C |
| PI3PRB | 010E | PIAST | FE57 | PIDFY | FFA0 | RAMP | FA78 | RANGE | FB7B |
| RMPST | FAA8 | RTCEN | 0027 | RTCIN | F61B | SCPDD | 001D | SCPDN | 001B |
| SCPDR | 001F | SCPDX | 0023 | SETC | FEC6 | SFLP | FF8C | SGNCK | FF03 |
| SGNFG | 002E | SHFT | FF89 | SK2 | F63C | SK3 | F644 | SK4 | F72A |
| SK5 | F70B | SKIP | FB0D | SMON | 0010 | SMSPB | 00E0 | SNCHG | FA84 |
| SPCON | F701 | SPD | 0005 | SPDER | 000F | SPDGZ | FAB9 | SPDHG | 0E10 |
| SPDLW | 0000 | SPDN | FE9D | SPDOF | FB30 | SPM | 0000 | SPMD | 0003 |
| SPMLP | F64F | SPP | 0007 | SPPO | 0011 | SPPSD | FA5D | START | FA29 |
| SUBD | FEBD | SVSG | FECD | TABLE | F7BE | TEMP0 | 0025 | TEMP1 | 0026 |
| TEMP2 | 0027 | TEMP3 | 0028 | TIME | F6F1 | TMCNT | 002F | WAIT | FE54 |
| WILD | F618 | WILD1 | F619 | ZCLP | FE4C | | | | |

TOTAL ERRORS 1

We claim:

1. A microprocessor-based speed control system energized by an electrical power source for controlling the speed of a steam turbine over a wide speed range from turning gear to substantially synchronous speed by controlling the steam admission thereto from a steam supply source using a hydraulically operated servomotor throttle valve, said system comprising:

a plurality of read-only-memories permanently preprogrammed with sets of digital instructions and data words in an addressable order for characterizing the speed control operation of the control system;

means for generating a system clock signal;

a microprocessor governed by the system clock signal to process the sets of instructions and data words of the programmed read-only-memories synchronous to the system clock signal;

means for temporarily storing a plurality of data words resulting from the processing operations of the microprocessor;

means responsive to electrical power turn-on to generate an initialization signal to said microprocessor, said microprocessor being responsive to said initialization signal to initialize the status of the microprocessor-based speed controller to a predetermined initial state by processing an initialization set of said sets of digital instruction and data words of the preprogrammed read-only-memories;

a real time clock for generating interrupts to said microprocessor, said microprocessor being responsive to said interrupts, only after processing said initialization set of digital words, to segregate its central processing activities into processing time intervals;

means for generating a signal representative of actual turbine speed;

first means, coupled to the microprocessor and functionally operative in cooperation therewith, for converting the signal representative of actual turbine speed to at least one speed measurement data word corresponding to each generated interrupted as governed by the processing of a first set of instructions and data words by the microprocessor for use thereby;

said microprocessor being operative to process a second set of said sets of instruction and data words to calculate a new value of measured turbine speed during each processing time interval in a first set of said segregated processing time intervals based on a function of a present value of measured turbine speed and the values of a predetermined number of speed measurement data words, both corresponding concomittantly with the processing time interval during which the new speed value is being calculated;

said microprocessor being further operative to process a third set of said sets of instruction and data words to reduce the error between each new value of measured turbine speed and a value of speed reference substantially concurrent therewith over said wide speed range by generating a control data word which is based on a real time function of said substantially concurrent measured and reference values of turbine speed, said third set of instructions being processed during each processing time interval in a second set of said segregated processing time intervals;

second means, coupled to the microprocessor and functionally operative in cooperation therewith, for converting said control data word generated by the microprocessor to a speed control signal as governed by the processing of a fourth set of instructions and data words by the microprocessor;

third means governed by the speed control signal to modulate the pressure of a hydraulic fluid signal which is coupled to the servomotor throttle valve for controlling the position thereof; and a control panel, coupled to the microprocessor and functionally operative in cooperation therewith, for entering data thereto and displaying data therefrom and selecting at least one of a plurality of predetermined speed control operating modes of the speed control system, said microprocessor being responsive to said panel mode selection, data entries and data displays in accordance with the processing of a fifth set of instructions and data words thereby.

2. The system in accordance with claim 1; wherein the real time clock signal governs the processing of one portion of the sets of instructions and data words by the microprocessor.

3. The system in accordance with claim 2 wherein the one portion of the sets of instructions and data words is divided into a first subportion comprising the first, second and fifth sets and a second subportion comprising the first, third and fourth sets, said first and second subportions being processed by the microprocessor during respective alternate periods of the real time clock signal.

4. The system in accordance with claim 1 further including:

means for detecting a malfunction in the microprocessor instruction processing operation and generating a malfunction signal in response thereto;

means for detecting a turbine disabling condition and generating a trip signal in response thereto; and means, disposed between the second means and the control pressure monitoring means, for effecting a closed position of the servomotor throttle valve in response to at least one of the malfunction and trip signals.

5. The system in accordance with claim 1 wherein the reduction of the error between the substantially concurrent speed measurement data word value and the speed reference value is performed by the microprocessor in accordance with a control function having a selected gain and time constant associated therewith.

6. The system in accordance with claim 5 further including a set of switches, coupled to the microprocessor, for supplying a digital code thereto as indicated by the state thereof, said microprocessor being responsive to the digital code to select a gain and a time constant data word from a table of gains and time constant data words preprogrammed in one of the plurality of programmed read-only-memories in accordance with the processing of the third set of instructions.

7. The system in accordance with claim 1 wherein a speed demand value and an acceleration value are entered, at times, from the panel to the microprocessor in accordance with the fifth set of instructions and data words processed by the microprocessor, the speed reference having the entered speed demand value as a final value being ramped thereto at the entered acceleration value governed by the selected panel operating mode; and wherein further the change in speed demand and acceleration value when entered through the panel, is incrementally performed by the microprocessor based on a function of the time during which the change is commanded by the panel.

* * * * *